US006724902B1

(12) United States Patent
Shennib et al.

(10) Patent No.: US 6,724,902 B1
(45) Date of Patent: Apr. 20, 2004

(54) CANAL HEARING DEVICE WITH TUBULAR INSERT

(75) Inventors: Adnan Shennib, Fremont, CA (US); Richard C. Urso, Redwood City, CA (US)

(73) Assignee: InSound Medical, Inc., Newark, CA (US)

( * ) Notice: Subject to any disclaimer, the term of this patent is extended or adjusted under 35 U.S.C. 154(b) by 0 days.

(21) Appl. No.: 09/303,086

(22) Filed: Apr. 29, 1999

(51) Int. Cl.[7] ..... H04R 25/00

(52) U.S. Cl. ..... 381/328; 600/25; 607/56; 607/57; 381/322; 381/325; 381/323; 381/329; 381/324

(58) Field of Search ..... 381/322, 324, 381/325, 328, 329, 323; 600/25; 607/56, 57

(56) References Cited

U.S. PATENT DOCUMENTS 1,683,316 A * 9/1928 Von Suchorzynski
4,006,796 A * 2/1977 Coehorst
4,539,440 A * 9/1985 Sciarra
5,979,589 A * 11/1999 Aceti
6,275,596 B1 * 8/2001 Fretz
6,359,993 B2 * 3/2002 Brimhall

* cited by examiner

*Primary Examiner*—Curtis Kuntz
*Assistant Examiner*—Dionne Harvey

(57) ABSTRACT

A canal hearing device with a dual acoustic seal system for preventing feedback while minimizing occlusion effects. The two-part device comprises a main module and an elongated tubular insert for conducting sound to the tympanic membrane and sealing within the bony region of the ear canal. The main module is positioned in the cartilaginous portion of the ear canal. The tubular insert comprises a sound conduction tube and a cylindrically hollow primary seal medially positioned in the bony region. The device also comprises a secondary seal laterally positioned in the cartilaginous region. The secondary seal, although providing additional acoustic sealing for the prevention of feedback, is sufficiently vented to provide a path of least acoustic resistance for occlusion sounds within the ear canal. In a preferred embodiment, the tubular insert comprises a coiled skeletal frame to provide high radial flexibility while maintaining sufficient axial rigidity for comfortable, kink-resistant, and consistent placement within the ear canal.

103 Claims, 11 Drawing Sheets

*Frequency Response (90 dB Input)*

CANAL HEARING DEVICE WITH TUBULAR INSERT

BACKGROUND OF THE INVENTION

A. Technical Field

The present invention relates to hearing devices, and, more particularly, to miniature hearing devices that are deeply positioned in the ear canal for improved energy efficiency, sound fidelity, and inconspicuous wear.

B. Description of the Prior Art

Brief Description of Ear Canal Anatomy

The external acoustic meatus (ear canal) is generally narrow and tortuous as shown in the coronal view in FIG. 1. The ear canal 10 is approximately 25 mm in length from the canal aperture 17 to the tympanic membrane 18 (eardrum). The lateral (away from the tympanic membrane) part, a cartilaginous region 11, is relatively soft due to the underlying cartilaginous tissue. The cartilaginous region 11 of the ear canal 10 deforms and moves in response to the mandibular (jaw) motions, which occur during talking, yawning, eating, etc. The medial (towards the tympanic membrane) part, a bony region 13 proximal to the tympanic membrane, is rigid due to the underlying bony tissue. The skin 14 in the bony region 13 is thin (relative to the skin 16 in the cartilaginous region) and is more sensitive to touch or pressure. There is a characteristic bend 15 that roughly occurs at the bony-cartilaginous junction 19, which separates the cartilaginous 11 and the bony 13 regions. The magnitude of this bend varies significantly among individuals. The internal volume of the ear canal between the aperture 17 and tympanic membrane is approximately 1 cubic centimeter (cc).

A cross-sectional view of the typical ear canal 10 (FIG. 2) reveals generally an oval shape and pointed inferiorly (lower side). The long diameter ($D_L$) is along the vertical axis and the short diameter ($D_S$) is along the horizontal axis. Canal dimensions vary significantly among individuals as shown below in the section titled Experiment A.

Physiological debris 4 in the ear canal is primarily produced in the cartilaginous region 11, and includes cerumen (earwax), sweat, decayed hair, and oils produced by the various glands underneath the skin in the cartilaginous region. There is no cerumen production or hair in the bony part of the ear canal. The ear canal 10 terminates medially with the tympanic membrane 18. Laterally and external to the ear canal is the concha cavity 2 and the auricle 3, both also cartilaginous.

Several types of hearing losses affect millions of individuals. Hearing loss particularly occurs at higher frequencies (4000 Hz and above) and increasingly spreads to lower frequencies with age.

The Limitations of Conventional Canal Hearing Devices

Conventional hearing devices that fit in the ear of individuals generally fall into one of 4 categories as classified by the hearing aid industry: (1) Behind-The-Ear (BTE) type which is worn behind the ear and is attached to an ear mold which fits mostly in the concha; (2) In-The-Ear (ITE) type which fits largely in the auricle and concha cavity areas, extending minimally into the ear canal; (3) In-The-canal (ITC) type which fits largely in the concha cavity and extends into the ear canal (see Valente M., *Strategies for Selecting and Verifying Hearing Aid Fittings*. Thieme Medical Publishing. pp. 255–256, 1994), and; (4) Completely-In-the-Canal (CIC) type which fits completely within the ear canal past the aperture (see Chasin, M. *CIC Handbook*, Singular Publishing ("Chasin"), p. 5, 1997).

The continuous trend for the miniaturization of hearing aids is fueled by the demand for invisible hearing products in order to alleviate the social stigma associating hearing loss with aging and disability. In addition to the cosmetic advantage of canal devices (ITC and CIC devices are collectively referred to herein as canal devices), there are actual acoustic benefits resulting from the deep placement of the device within the ear canal. These benefits include improved high frequency response, less distortion, reduction of feedback and improved telephone use (Chasin, pp. 10–11).

However, even with these significant advances leading to the advent of canal devices, there remains a number of fundamental limitations associated with the underlying design and configurations of conventional canal device technology. These problems include: (1) oscillatory (acoustic) feedback, (2) custom manufacturing and impression taking, (3) discomfort, (4) occlusion effect and, (5) earwax. These limitations are discussed in more detail below.

(1) Oscillatory feedback occurs when leakage (arrows 32 and 32' in FIG. 3) from sound output 30, typically from a receiver 21 (speaker), occur via a leakage path or a vent 23. The leakage (32') reaches a microphone 22 of a canal hearing device 20 causing sustained oscillation. This oscillatory feedback is manifested by "whistling" or "squealing" and is not only annoying to hearing aid users but also interferes with their communication. Oscillatory feedback is typically alleviated by tightly occluding (sealing) the ear canal. However, due to imperfections in the custom manufacturing process (discussed below) or to the intentional venting incorporated within the hearing device (also discussed below) it is often difficult if not impossible to achieve the desired sealing effect, particularly for the severely impaired who require high levels of amplification. Oscillatory feedback primarily typically occurs at high frequencies due to the presence of increased gain at these frequencies.

(2) Custom manufacturing and impression taking: Conventional canal devices are custom made according to an impression taken from the ear of the individual. The device housing 25 (FIG. 3), known as shell, is custom fabricated according to the impression to accurately assume the shape of the individual ear canal. Customizing a conventional canal device is required in order to minimize leakage gaps, which cause feedback, and also to improve the comfort of wear. Custom manufacturing is an imperfect process, time consuming and results in considerable cost overheads for the manufacturer and ultimately the hearing aid consumer (user). Furthermore, the impression taking process itself is often uncomfortable for the user.

(3) Discomfort, irritation and even pain frequently occur due to canal abrasion caused by the rigid plastic housing 25 of conventional canal devices 20. This is particularly common for canal devices that make contact with the bony region of the ear canal. Due to the resultant discomfort and abrasion, hearing devices are frequently returned to the manufacture in order to improve the custom fit and comfort (Chasin, p. 44). "The long term effects of the hearing aid are generally known, and consist of atrophy of the skin and a gradual remodeling of the bony canal. Chronic pressure on the skin lining the ear canal causes a thinning of this layer, possibly with some loss of skin appendages" (Chasin, p. 58).

(4) The occlusion effect is a common acoustic problem caused by the occluding hearing device. It is manifested by the perception of a person's "self-sounds" (talking, chewing, yawning, clothes rustling, etc) being loud and unnatural compared to the same sounds with the open (unoccluded) ear canal. The occlusion effect is primarily due to the low frequency components of self-sounds and may be experienced by plugging the ears with fingers while talking for example. The occlusion effect is generally related to sounds resonating within the ear canal when occluded by the hearing device. The occlusion effect is demonstrated in FIG. 3 when "self-sounds" 35, emanating from various anatomical structures around the ear (not shown), reach the ear canal 10. When the ear canal is occluded, a large portion of self-sounds 35 are directed towards the tympanic membrane 18 as shown by arrow 34. The magnitude of "occlusion sounds" 34 can be reduced by incorporating an "occlusion-relief vent" 23 across the canal device 30. The occlusion-relief vent 23 allows a portion of the "occlusion sounds" 35 to leak outside the ear canal as shown by arrow 35'. The occlusion effect is inversely proportional to the residual volume of air between the occluding hearing device and the tympanic membrane. Therefore, the occlusion effect is considerably alleviated by deeper placement of the device in the ear canal. However, deeper placement of conventional devices with rigid enclosures is often not possible for reasons including discomfort as described above. For many hearing aid users, the occlusion effect is not only annoying, but is often intolerable leading to discontinued use of the canal device.

(5) Earwax build up on the receiver of the hearing device causing malfunction is well known and is probably the most common factor leading to hearing aid damage and repair (Oliveira, et al, *The Wax Problem: Two New Approaches*, The Hearing journal, Vol. 46, No. 8).

The above limitations in conventional canal devices are highly interrelated. For example, when a canal device is worn in the ear canal, movements in the cartilaginous region "can lead to slit leaks that lead to feedback, discomfort, the occlusion effect, and 'pushing' of the aid from the ear" (Chasin, pp. 12–14). The relationship between these limitations is often adverse. For example, occluding the ear canal tightly is desired on one hand to prevent feedback. However, tight occlusion leads to the occlusion effect described above. Attempting to alleviate the occlusion effect by a vent 23 provides an opportunistic pathway for output sound 30 (FIG. 3) to leak back (arrows 32 and 32') and cause feedback. For this reason alone, the vent 23 diameter is typically limited in CIC devices to 0.6–0.8 mm (Chasin, pp. 27–28).

Review of State-of the-art in Related Hearing Device Technology

Ahlberg, et al and Oliviera, et al in U.S. Pat. Nos. 4,880,076 and 5,002,151 respectively, disclose an earpiece with sound conduction tube having a solid compressible polymeric foam assembly. The retarded recovery foam must first be compressed prior to its insertion into the ear canal to recover and seal within. However, a compressible polymeric foam can be uncomfortable and irritating to the ear canal after recovering (i.e., being decompressed). Furthermore, many impaired individuals do not possess the required manual dexterity to properly compress the foam prior to insertion in the ear canal.

Sauer et al., in U.S. Pat. No. 5,654,530, disclose an insert associated with an ITE device (FIG. 1 in Sauer) or a BTE device (FIG. 2 in Sauer). The insert is a "sealing and mounting element" for a hearing device positioned concentrically within the insert. Sauer's disclosure teaches an insert for ITEs and BTEs; it does not appear to be concerned with inconspicuous hearing devices that are deeply or completely inserted in the ear canal, or with delivering sound and sealing in the bony region of the canal.

Garcia et al., in U.S. Pat. No. 5,742,692 disclose a hearing device (10 in FIG. 1 of Garcia) attached to a flexible seal (collar 30) which is fitted in the bony region of the ear canal. The device 10 is substantially positioned in the cartilaginous region along with the collar 30, which is partially positioned over the housing. It is not clear how the disclosed device with its contiguous housings and seal configuration can fit comfortably and deeply in many small and contoured canals.

Voroba et al in U.S. Pat. No. 4,870,688 discloses a mass-producible hearing aid comprising a solid shell core (20 in FIGS. 1 and 2 of Veroba) which has a flexible covering 30 affixed to the exterior of the rigid core 20. The disclosed device further incorporates a soft resilient bulbous tubular segment 38 for delivering sound closer to the tympanic membrane and sealing within. Similarly, it is unlikely for this contiguous device/tubular segment to fit comfortably and deeply in many small and contoured canals.

None of above inventions addresses the occlusion effect other than by the conventional vent means, which are known to adversely cause oscillatory feedback.

McCarrell, et al, Martin, R., Geib, et al., Adelman R., and Shennib, et al., in U.S. Pat. No. 3,061,689, U.S. Pat. Nos. 26,258, 3,414,685, 5,390,254, and 5,701,348, respectively, disclose miniature hearing devices with a receiver portion flexibly connected to a main part. Along with various accessories including removable acoustic seals, these devices have the advantage of fitting a variety of ear canal sizes and shapes thus are mass-producible in principle. However, the flexible or articulated receiver portion in these devices requires flexible mechanical and electrical connections, which result in added cost and reduced reliability compared with conventional devices which comprise instead immobile receivers contained in a singular rigid housing. Furthermore, by incorporating a seal mechanism concentrically over a rigid receiver, or a rigid receiver section, the compressibility of the seal, regardless of its compliance, is severely limited by the rigid core section which has a substantial diameter compared with the ear canal.

Ward et al., in U.S. Pat. Nos. 5,031,219 and 5,201,007, disclose a sound conduction tube (60 in Ward) for conveying amplified sound to the ear canal within the bony region in close proximity to the tympanic membrane (30). The invention also comprises a "flexible flanged tip" (70), essentially a seal, for acoustically sealing in the bony region. Ward et al. state two main objectives, viz.: "To assure proper operation of the present invention, the hearing aid should [1] neither prevent unamplified sound received at the ear from entering the ear canal, [2] nor should it contact a substantial portion of the skin lining the ear canal" (lines 32–36 col. 4 in the '219 patent and lines 37–41 col. 4 in the '007 patent). The present applicants have concluded that these limitations cause serious disadvantages for practical implementation in canal hearing devices. First, unamplified sound is allowed to freely enter the ear canal which also allows amplified sound in the bony region, which partially leaks into the cartilaginous region, to feed back to the microphone of the device and cause oscillatory feedback. This occurs because some level of leakage is always present through any acoustic barrier. Second, the contact area of the seal with the ear canal is minimized (see FIGS. 1 and 5A–5F in '219 and '007, and the recital "it has been found that a suitable edge 72 thickness is approximately 0.05 to 2 millimeters."), so that adequate sealing along this small contact area is not possible without exerting considerable pressure on the ear canal. This is particularly problematic for canal devices having a microphone relatively in close proximity to leakage in the open ear canal as suggested and shown in the figures.

Although Ward et al. briefly mention potential applications of their devices for canal devices (lines 22–26 col. 4 in '219 and lines 27–31 col.4 in '007), the practical application is limited to BTE hearing aids with microphones far and away external to the ear canal (91 in FIG. 3. in both the '219 and '007 patents).

It is a principal objective of the present invention to provide a highly inconspicuous hearing device.

A further objective is to provide a hearing device which comfortably delivers amplified sound in the bony region in close proximity to the tympanic membrane.

Another objective is to provide an acoustic system in which acoustic sealing is maximized for prevention of feedback while simultaneously minimizing occlusion effects.

Still another objective is to improve the frequency response of delivered sound, particularly at higher frequencies while reducing occlusion sounds particularly at lower frequencies.

Yet another objective is to provide a mass-producible hearing device design which does not require custom manufacturing or individual ear canal impression.

Unlike the prior art, the present invention is not concerned with allowing external unamplified sounds to enter the ear canal.

SUMMARY OF THE INVENTION

The invention provides a canal hearing device with a dual acoustic seal system for preventing oscillatory feedback while simultaneously channeling occlusion sounds away from the eardrum, thus minimizing occlusion effects. The two-part canal hearing device comprises a generic main module and an elongated tubular insert for conducting sound from the main module to the tympanic membrane and for sealing within the ear canal. The main module is positioned in the cartilaginous portion of the ear canal, either in the medial concha area or medially past the aperture of the ear canal. The replaceable tubular insert extends medially from the cartilaginous region into the bony portion of the ear canal. The tubular insert comprises a flexible sound conduction tube, a primary seal medially positioned in the bony region, and a secondary seal laterally positioned in the cartilaginous region. The sound conduction tube is radially flexible and has a diameter substantially smaller than that of the ear canal, for ease of insertion within. The primary and secondary seals are generally cylindrically hollow and are coaxially concentrically positioned over the sound conduction tube for making a substantial sealing contact with the walls of the ear canal thus distributing and minimizing contact pressure. The primary seal and the tympanic membrane form a first chamber of air-space therebetween. The primary and secondary seal also form a second chamber therebetween. The secondary seal, although providing additional acoustic sealing benefits for the prevention of feedback, also has a relatively large vent, compared to the pressure vent associated with the primary seal. This provides a path of least resistance towards outside the ear for occlusion sounds generated by the individual wearing the hearing device.

In a preferred embodiment of the invention, the tubular insert is disposable and comprises a coiled skeletal frame to provide high radial flexibility while maintaining sufficient axial rigidity for comfortable, kink-resistance, and consistent placement within the ear canal.

In another embodiment of the invention, the tubular insert comprises only a primary seal system positioned in the bony region while the secondary seal is provided within the main module fitted in the ear canal. Similarly, the main module is appropriately vented to provide a path of least resistance for occlusion sounds while providing additional sealing for the prevention of oscillatory feedback.

BRIEF DESCRIPTION OF THE DRAWINGS

The above and other objectives, features, aspects and attendant advantages of the invention will become further apparent from a consideration of the following detailed description of the presently contemplated best mode of practicing the invention, with reference to certain preferred embodiments and methods thereof, in conjunction with the accompanying drawings, in which.

DETAILED DESCRIPTION OF THE PREFERRED EMBODIMENTS AND METHODS

The invention provides a canal hearing device with a dual acoustic seal system for preventing oscillatory feedback while simultaneously channeling occlusion sounds away from the tympanic membrane (eardrum), thus minimizing occlusion effects.

Figure 1:
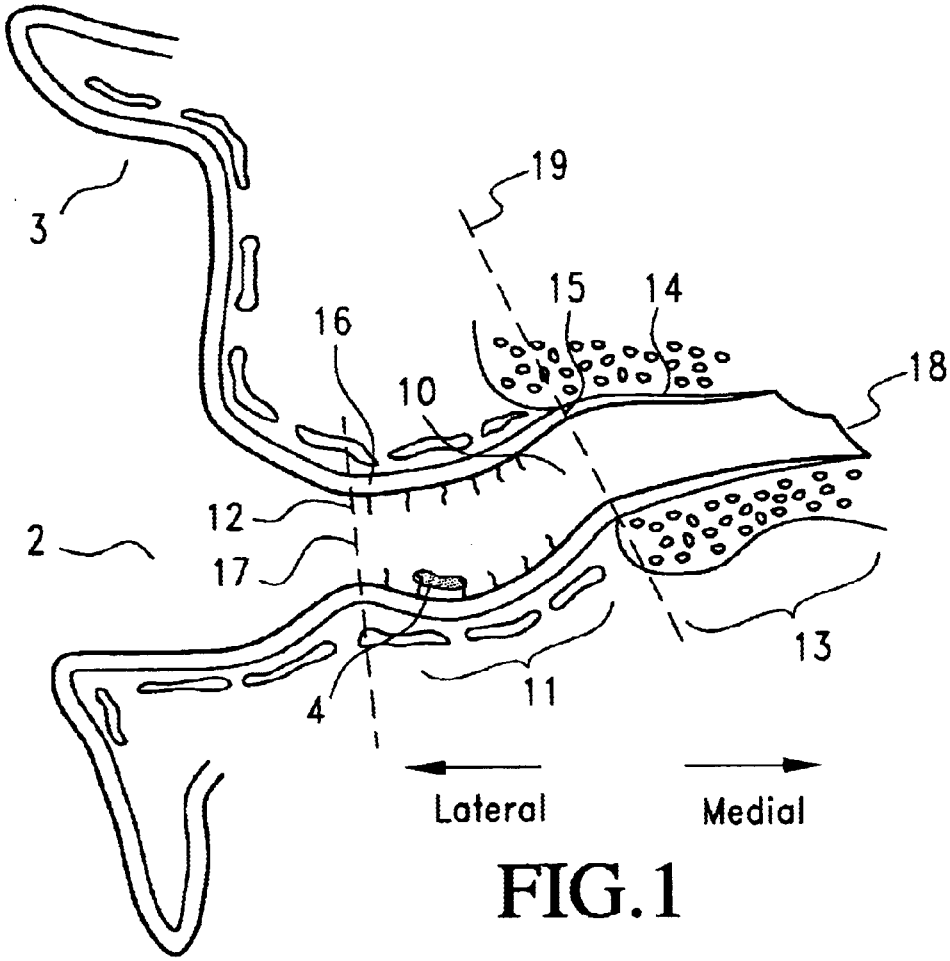
FIG. 1 is a side view of the human ear canal, described above.
Figure 2:
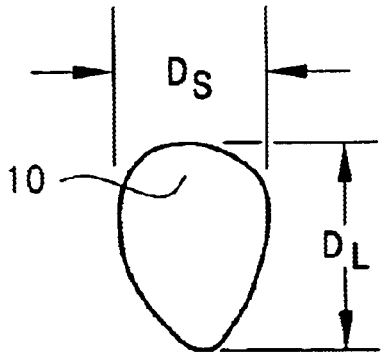
FIG. 2 is a cross sectional view of the typical ear canal.
Figure 3:
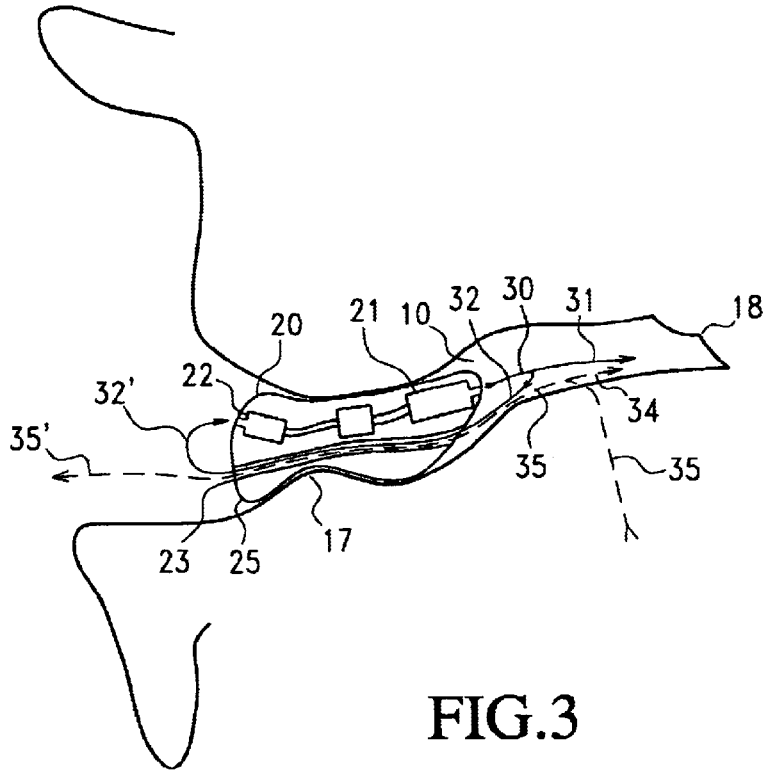
FIG. 3 is a side view of the ear canal occluded with conventional canal device positioned therein, described above.
Figure 4:
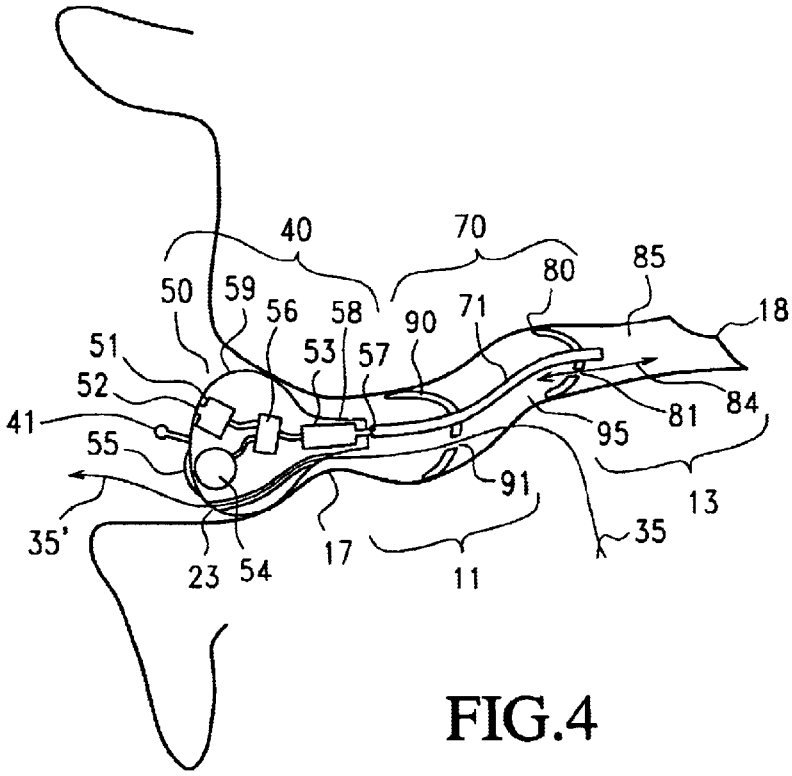
FIG. 4 is a side view of a hearing device according to a preferred embodiment of the invention comprising a main module and a tubular insert having a dual seal system, in which occlusion mitigation via occlusion-relief vent is shown.
Figure 5:
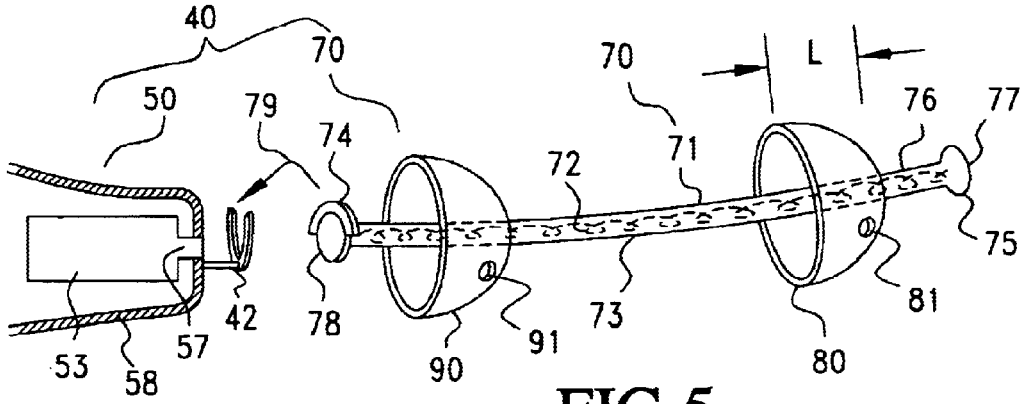
FIG. 5 shows a tubular insert with flange-shaped primary and secondary seals and sound conduction tube connecting to a receiver sound port via a side-slide connection mechanism.

In the preferred embodiments shown in FIGS. 4–5, the canal hearing device 40 comprises a main module 50 and a tubular insert 70. The main module 50 is positioned primarily in the cartilaginous region 11 of the ear. The tubular insert 70 comprises an elongated sound conduction tube 71, a primary seal 80 medially positioned in the bony region 13, and a secondary seal 90 laterally positioned in the cartilaginous region. The primary seal 80 and secondary seal 90 are hollow and generally cylindrical in shape. They are also soft and conforming for fitting comfortably and in a sealing manner within the ear canal 10. The tubular insert 70 is removably attachable from the main module 50. In the preferred embodiments of the invention, the tubular insert 70 is disposable.

The main module comprises a housing 59 containing typical hearing aid components including, but not limited to, microphone 51, receiver 53, receiver sound port 57, battery 54, signal amplifier 56 and device controls (e.g., volume trimmer, not shown) for controlling or adjusting functions of the hearing device. The sound conduction tube 71 conducts amplified sound from receiver sound port 57 to the tympanic membrane 18.

Figure 17:
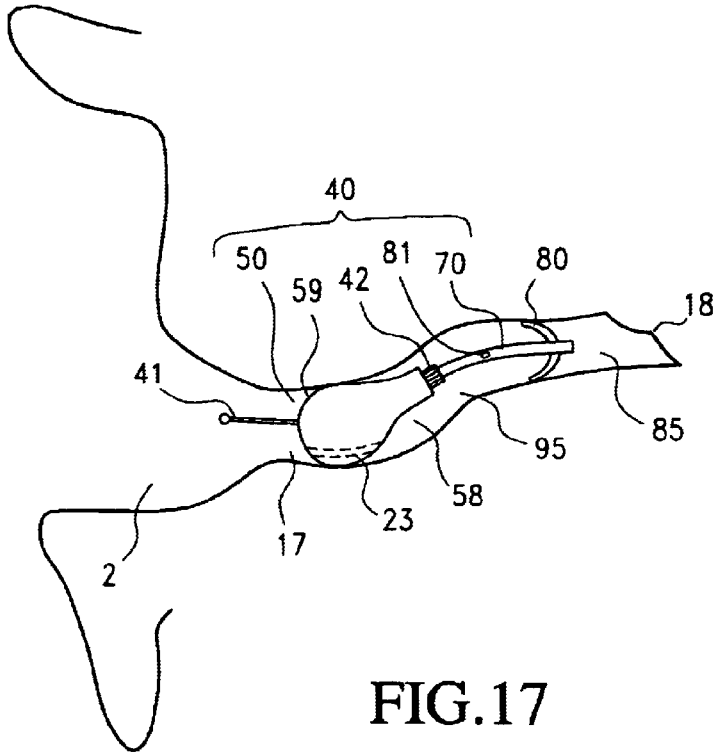
FIG. 17 shows a completely in the canal (CIC) configuration of the invention.

The main module is positioned in the cartilaginous portion of the ear canal, either partially past the aperture of the ear canal (FIG. 4) or completely past the aperture medially (FIG. 17). However, the receiver section 58 of main module 50 is positioned in the cartilaginous part of the ear canal past the aperture. The receiver section 58 has a diameter smaller than the ear canal 10, thus making little or no contact at all with the wall of the ear canal.

The tubular insert 70 extends medially from the cartilaginous region 11 into the bony portion 13 of the ear canal. The sound conduction tube 71 has a diameter considerably smaller than that of the ear canal and is radially flexible for ease of insertion and for flexing during canal deformations associated with jaw movements. However, the sound conduction tube is axially sufficiently rigid to provide kink-resistance and torque ability for proper and consistent placement within the ear canal. In a preferred embodiment of the invention, the sound conduction tube 71 (FIG. 5) comprises a thin tubular sheath 73 and a skeletal frame 72 (e.g., coil) for achieving the desired radial and axial properties. Skeletal frame 72 is preferably composed of metal or metal alloy.

The primary seal 80 and secondary seal 90 are cylindrically hollow and coaxially concentrically positioned over the sound conduction tube 71. The cross-sectional diameters of primary seal 80 and secondary seal 90 are substantially larger than the diameter of the sound conduction tube 71, and the seals themselves are sufficiently spaced-apart, in order to provide a substantial range of conformability for improved comfort and acoustic sealing within the ear canal.

The primary seal 80 and the tympanic membrane 18 form a first chamber 85 (FIG. 4) of air-space therebetween. The primary seal 80 and secondary seal 90 form a second chamber 95 therebetween. The secondary seal 90, although providing additional acoustic sealing function for the prevention of oscillatory feedback, also has a relatively large vent 91, compared to pressure vent 81 (FIGS. 4 and 5) on the primary seal 80. The large vent 91, referred to herein as occlusion-relief vent, provides a path of least resistance for occlusion sounds 35 (FIG. 4) generated by the individual wearing the hearing device 40.

The tubular insert 70 is removably connected to receiver section 58 and particularly receiver sound port 57 via an appropriate physical connection. In a preferred embodiment shown in FIG. 5, the tubular insert comprises a tube connector 74, at the lateral end 78 of sound conduction tube 71. The tube connector 74 slides sidewise into a receiver connector 42 in the direction shown by arrow 79. The removal is similarly achieved by side-sliding the tubular insert in the opposite direction. A side-slide connection mechanism is advantageous for providing a secure connection and preventing accidental disconnection of the tubular insert while the device is being removed from the ear canal 10.

Figure 6:
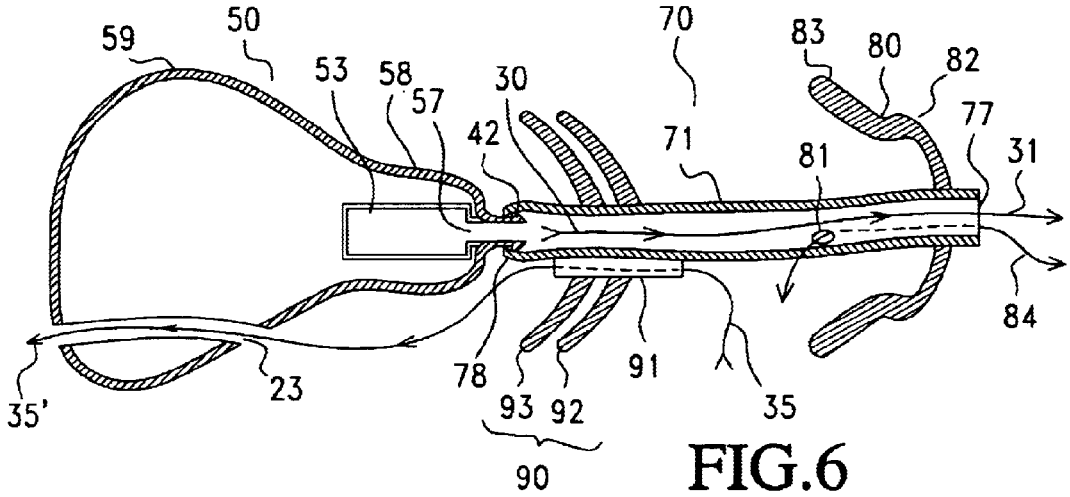
FIG. 6 shows a tubular insert with alternate configurations for primary seal, secondary seal, pressure vent, and occlusion relief vent.

The contact of the seals, particularly the primary seal 80 along the walls of the ear canal in the bony region, should span a length (L in FIG. 5) of at least2 mm for an effective acoustic sealing within. This span is also necessary to distribute and minimize contact pressure for improved comfort. The seals should have rounded edges and smooth surfaces to provide a comfortable and effective acoustic sealing. For example, in FIGS. 4 and 5 the seals are essentially flanged or mushroom shaped as shown. However, the shape or configuration may be different while achieving equal or even improved effectiveness. In FIG. 6 for example, the primary seal 80 is shaped with a rounded leading edge 82 and a lagging flange 83. This combination is suitable for providing insertion comfort and effective sealing. The secondary seal is shown alternatively with a pair of clustered flanged seals comprising a leading seal 92 and lagging seal 93. The possibilities of seal designs and configurations are numerous, as will become obvious to those skilled in the art from the description herein.

The sound conduction tube 71 may be extended medially past the primary seal 80 as shown in FIG. 5. Tube extension 76 allows tube sound opening 77 to be in closer proximity to the tympanic membrane 18 for a more effective, energy efficient, and faithful sound reproduction. The tube extension 76 may comprise a rounded tip 75 to minimize the possibility of canal abrasion during insertion of the tubular insert in the ear canal.

The sound conduction tube 71 of the tubular insert 70 must be sufficiently narrow in diameter and elongated to achieve comfortable deep insertion into the bony region 13. Furthermore, by appropriately selecting the appropriate ratio of diameter and length of the sound conduction tube 71, the characteristics of sound delivered 31 (FIG. 6), particularly at high frequencies can be significantly improved. It has been determined by experiments (see, for example, Experiments B and C described below) that optimal performance of the tubular insert of the invention is achieved by sound conduction tube 71 having a length of at least 8 mm and a inside diameter (ID) range between 1 and 2 mm. The outside diameter (OD) is preferably less than 2.5 mm. The wall thickness of the sound conduction tube 71 is preferably less than 0.4 mm in order to ensure proper flexibility of the sound conduction tube.

The elongated tubular insert 70, having a length of at least 8mm, considerably reduces, if not completely eliminates, the problem of cerumen (earwax) build up on sound port 57 of the receiver. This is partially due to the length of the sound conduction tube 71 presenting a substantial separation between the tube sound opening 77 and receiver sound port 57. In addition, any presence or accumulation of cerumen within the sound conduction tube 71 will be disposed of as the user periodically discards the disposable tubular insert.

The occlusion-relief vent 91 of the secondary seal 90 may be in the form of a hole as shown in FIGS. 4 and 5, or alternatively as a tube as shown in FIG. 6. The occlusion-relief vent 91 may be essentially provided as any conductive acoustic pathway connecting, directly or indirectly, the second chamber 95 with the outside of the ear (FIG. 4).

On the other hand, the pressure vent 81 associated with the primary seal, is provided primarily for air pressure equalization to prevent damage to the tympanic membrane. This equalization, shown by dual arrows 84 (FIG. 4), is required during device insertion or removal, or for changes in atmospheric pressures experienced in an airplane for example. The diameter of the pressure vent 81 must be very small so as to provide substantial sealing within the bony region of the ear canal. Holes of diameter less than 0.5 mm are known to have minimal acoustic impact in terms of leakage or modification of the acoustic response near the tympanic membrane. The pressure vent hole 81 may be directly incorporated within the primary seal as shown in FIGS. 4 and 5. Alternatively, a miniature hole 81 (FIG. 6) along the tubing of the sound conductive tube 71 is equally effective as an indirect way to pressure vent the primary seal 80. The pressure vent may also be in the form of a slit (81 in FIG. 12A), cavity (not shown) or a tube (not shown). An actual vent hole for pressure venting may not be required if minute leakage is present across the primary seal. It is well known in the field of acoustics that minute leakages generally do not effect the acoustic conduction nor adversely cause oscillatory feedback. For example, pressure vent leakage can be achieved by an air-permeable seal or by purposely designing an imperfect seal along the perimeter of the acoustic seal.

Regardless of the actual pressure venting employed, the occlusion-relief vent 91 must be substantially larger than pressure relief vent 81. The occlusion-relief vent is preferably larger than 1 mm in diameter. The cross-sectional area of the occlusion-relief vent is preferably at least 3 times that of the pressure vent. This is necessary in order to provide a path of least resistance for occlusion sounds within the second chamber 95. The substantial difference in acoustic impedance for the two venting systems may be achieved by other design means in addition to hole diameter. For example, by providing a plurality of smaller holes (not shown) or by adjusting the length of a vent tube (91 in FIG. 6). Regardless of the venting method used, the acoustic impedance of the pressure vent must be substantially larger than that of the occlusion-relief vent, preferably by at least 10 decibels at frequencies below 500 Hz, which are the primary frequencies causing occlusion effect.

The relative magnitude of venting by the dual seal system of the present invention is important for achieving the desired occlusion relief However, the accumulative sealing effect of the two seals, on the other hand, is also important for increasing the maximum gain or amplification of the hearing device 40 prior to reaching oscillatory feedback. This is also known as gain before feedback.

The main module must also-provide means for ensuring proper occlusion relief venting as shown by arrows 35 and 35' in FIGS. 4 and 6. This venting may be accomplished by an actual device vent 23 (FIGS. 4 and 6) or by an imperfect fit of the main module within the ear.

The connection mechanism between the tubular insert 70 and the receiver section 58 may be of any suitable configuration for providing a secure and effective connection. For example, FIG. 6 shows an alternative connection with a nozzle as a receiver connector 42, which is fitted directly within the lateral end 78 of the flexible sound conductive tube 71. In yet another mating configuration, the tube connector 74 (FIG. 7) is fitted concentrically coaxially over the receiver section 58. Other mating mechanisms (not shown) include threaded, snap-on and pressure-fit designs, or any combination of the above, as known by those skilled in the art of miniature mechanics.

Figure 7:
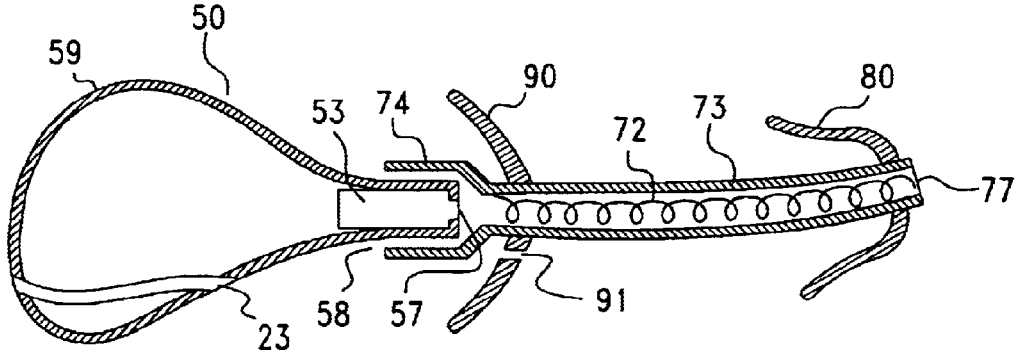
FIG. 7 shows a tubular insert with alternate attachment concentrically positioned over the receiver section of the main module, and with a coiled skeletal frame within a sound conduction tube.

In the embodiments shown in FIGS. 5 and 7, the sound conduction tube 71 comprises a coiled skeletal frame 72, which is inserted within a protective thin tubular sheet 73. The coil provides desirable mechanical properties, radial and axial, such as being non-collapsible and kink-resistant, in response to torque and other forces as the sound conduction tube 71 is being inserted in the ear canal. This is important in order to minimize adverse acoustic effects on output sound (30 and 31 in FIG. 6) as it travels medially within the sound conduction tube towards the tympanic membrane 18.

Figure 8:
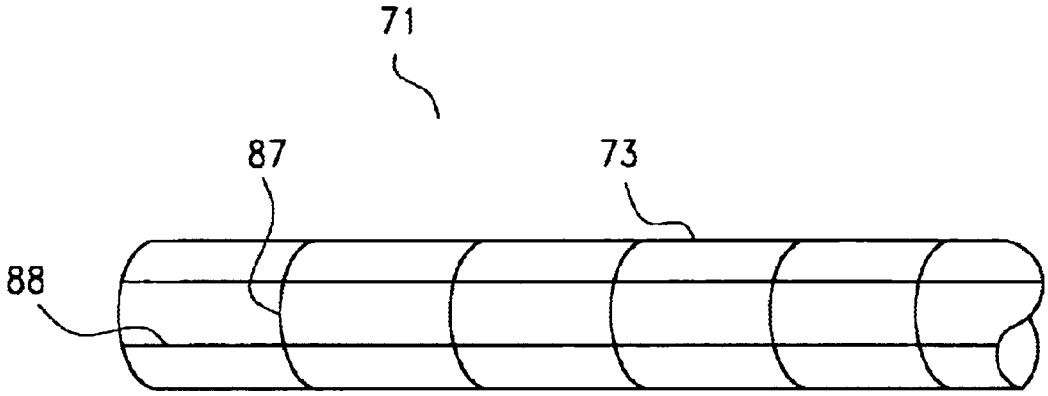
FIG. 8 shows circular and longitudinal support elements within the sound conduction tube of the tubular insert.
Figure 9:
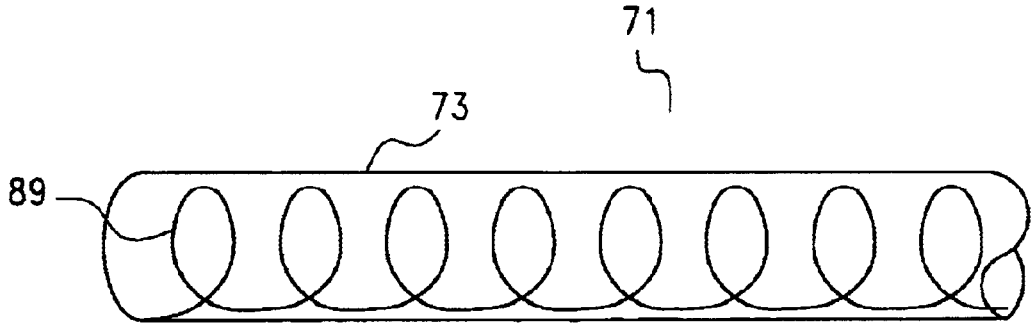
FIG. 9 shows helical support element within sound conduction tube of tubular insert.

The desired mechanical properties of the sound conduction tube 71 may be alternatively achieved by incorporating circular support elements 87 and longitudinal support elements 88 as shown in FIG. 8. These support elements may be molded of the same material used in the fabrication of the tubular sheath 73 or may be of different material molded within the tubular sheath 73. The combination of these support elements can be numerous and includes helical support elements (89 in FIG. 9), braided element (not shown) and other configurations known by those skilled in the art of tube and catheter designs.

Figure 10:
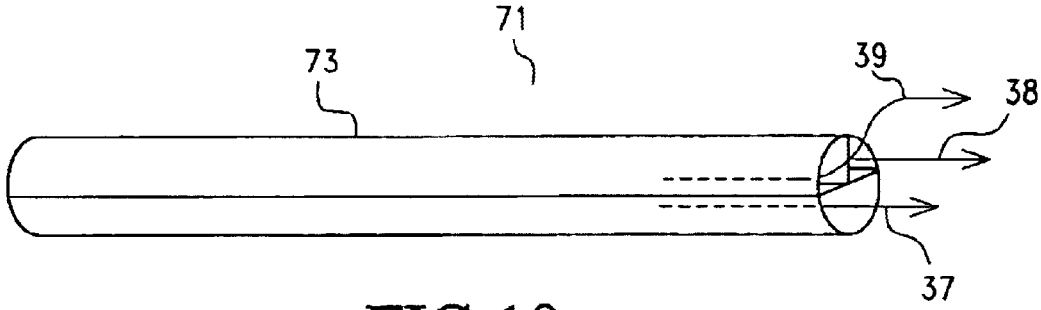
FIG. 10 shows a multichannel tubing within sound conduction tube for separately conducting multiple channels of sounds to the tympanic membrane.
Figure 11:
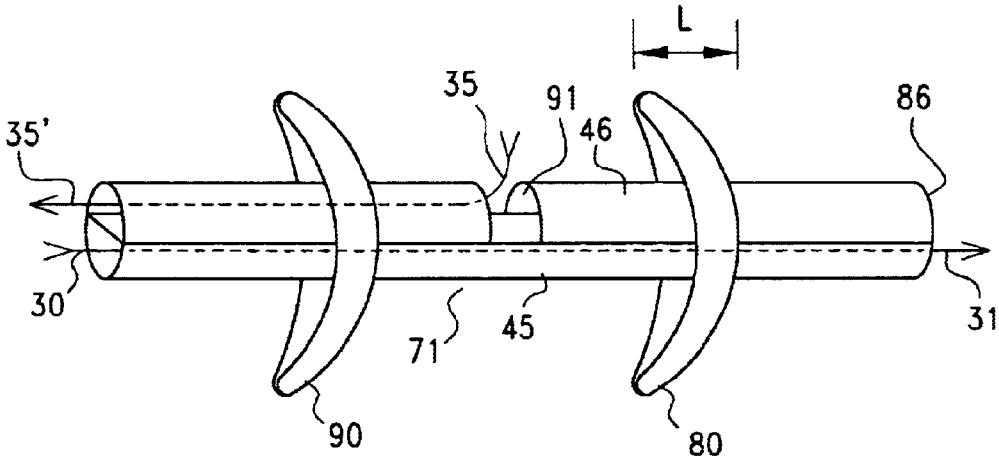
FIG. 11 shows a multichannel tubing for separately conducting sound medially to the tympanic membrane and occlusion sounds laterally away from the tympanic membrane.

The sound conduction tube 71 may comprise more than one tube, i.e. multilumen, for conducting multiple sound channels for separately conducting occlusion sounds 35. For example, FIG. 10 shows a sound conduction tube 71 having three channel paths (37, 38 and 39). Each channel may be optimized to achieve a desired acoustic effect such as filtering or high frequency boosting as commonly known in the field of hearing aid acoustics design. FIG. 11 shows sound conduction tube 71 with two channels 45 and 46. The first channel 45 conducts output sounds 30, 31, medially toward the tympanic membrane. The second channel 46 is blocked by a medial wall 86 on its medial end. However, second channel 46 incorporates an occlusion-relief vent 91, which allows occlusion sounds to substantially leak out as shown by arrows 35 and 35'.

The tubular insert 70 is preferably made, at least partially, of rubber or rubber-like material, such as silicone, in order to provide the desired mechanical and acoustic characteristics. These materials are generally durable, inexpensive and easy to manufacture. Other suitable material includes foam and other polymers, which can also be formed into tubular shapes (for the sound conduction tube) and cylindrically hollow shapes (for the seals).

The cross sectional perimeter shape of primary or secondary seal may be circular (FIG. 12A), elliptical (FIG. 12B) or oval and inferiorly pointed (FIG. 12C) for matching the cross-sectional diameter of the typical ear canal. The seals must be flexible to comfortably conform to the shape of the ear canal while providing the necessary acoustic sealing.

The seals may incorporate a lubricant material (not shown), particularly along the contact surface, to further facilitate insertion and removal within the ear canal. The seals may also be treated with medication material to minimize possible contamination and infections within the ear canal. The medication may include anti-bacterial, anti-microbial and like agents, for example.

Due to variations in canal size and shape across individuals, the tubular insert 70 is preferably provided in assorted generic sizes in order to properly fit the vast majority of individuals without resorting to any custom fabrication. An experiment to study the range of canal sizes, particularly the diameters was conducted as explained below in the section titled Experiment A.

The main module 50 of the preferred embodiment is fitted inconspicuously in medial end of the concha cavity 2, which is behind the tragus notch (not shown). Concha cavity placement (see FIGS. 4 and 13) is also especially desirable for persons of limited manual dexterity because it is relatively accessible for insertion and removal. The receiver section 58 extends medially into the ear canal past the aperture 17. A handle 41 may be used to further facilitate insertion and removal. The housing 59 of the main module 50 must be rigid for durable protecting of the enclosed components.

The main module is preferably universal in shape (generic) to fit the vast majority of ears in the concha cavity 2. This is possible for at least three reasons. First, the exact fit of the main module in the ear is not critical since sealing is primarily achieved by the primary seal 80, and to a lesser extent by the secondary seal 90. Second, the concha cavity, at its medial end, generally has a generic funnel-like shape. Third, the ear at the concha cavity area is relatively flexible thus somewhat conforms to the rigid housing 59 of the main module 50 when inserted within.

Figure 13:
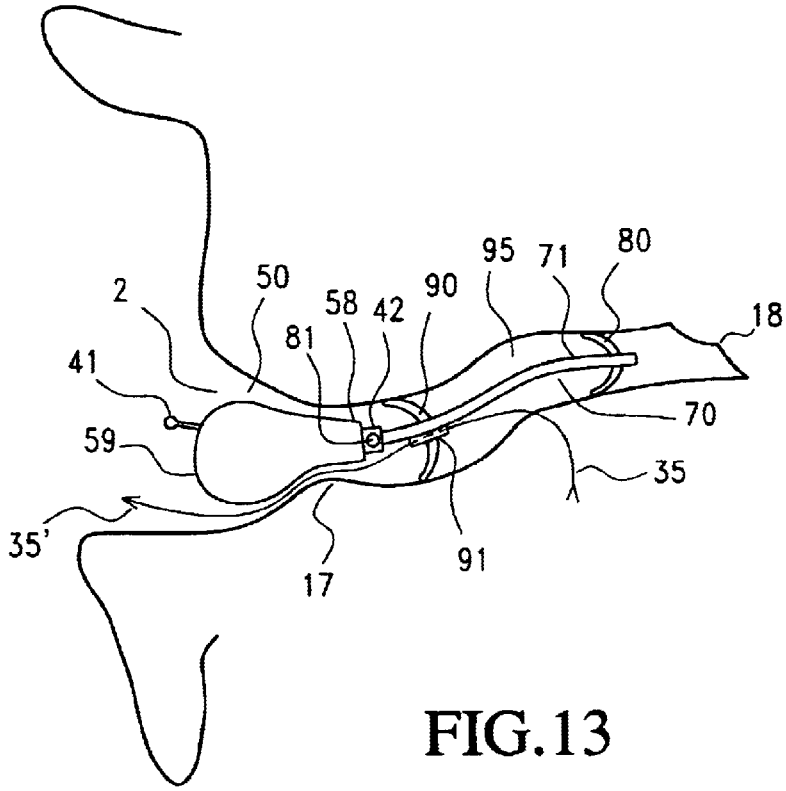
FIG. 13 shows an alternate configuration of the main module essentially suspended by the secondary seal with minimal or no contact with the walls of the ear canal.
Figure 14:
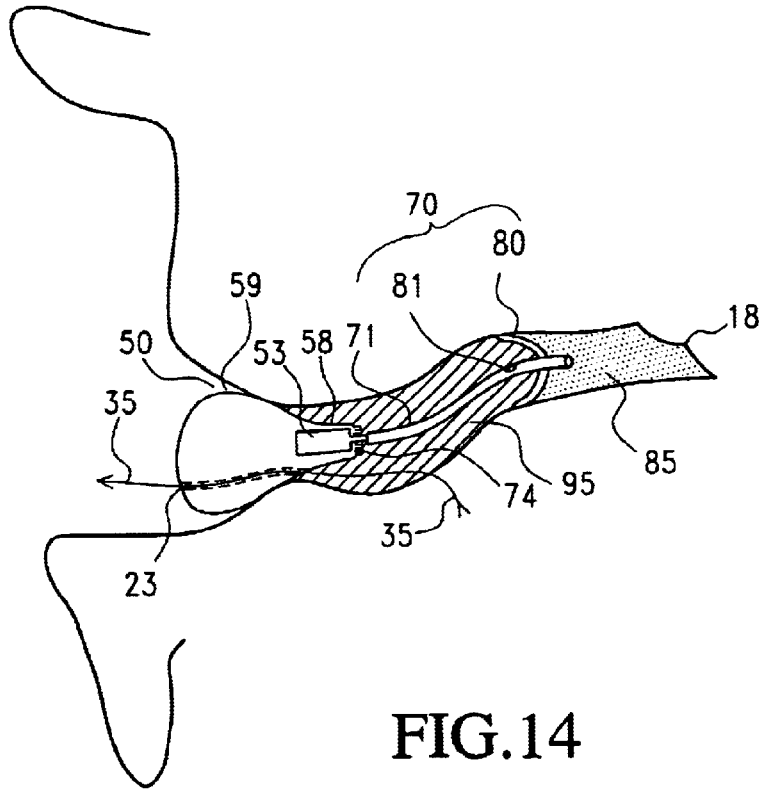
FIG. 14 is an alternate embodiment of the invention with the body of the main module providing the secondary sealing and occlusion venting incorporated within.

In the embodiment of FIG. 13, the main module 50 makes no contact at all with the walls of the ear. The main module 50 is essentially suspended by the secondary seal 90, which provides physical support for the main module as well as the sound conduction tube as shown in FIG. 13. The substantial clearance between the housing 59 of the main module 50 and the walls of the ear allow occlusion sounds 35 from the occlusion relief vent 91 to freely exit as shown. This eliminates the need for a separate vent within main module 50 as is the case in the above embodiments shown in FIGS. 4, 6 and 7. A pressure vent 81, associated with venting the primary seal 80, is alternatively positioned within receiver connection 42 (FIG. 13).

In yet another alternate embodiment of the invention the dual seal system is distributed between a primary seal within a tubular inset and a secondary seal within the main housing as shown in FIGS. 14–17. In these embodiments, the tubular insert 70 comprises only a primary seal 80 for positioning in the bony region 13. The secondary seal is provided by housing of the main module, which is fitted in a sealing manner within the ear. This is possible because the medial concha area has a generic shape as mentioned above. The secondary seal of the main module provides the additional required sealing for the prevention of oscillatory feedback. Similarly, the primary seal 80 and the tympanic membrane 18 form a first chamber therebetween. The second chamber 95 is formed between the main module 50 and the primary seal 80. An occlusion-relief vent 23 within main module 50 provides a path of least resistance for occlusion sounds 35.

Figure 15:
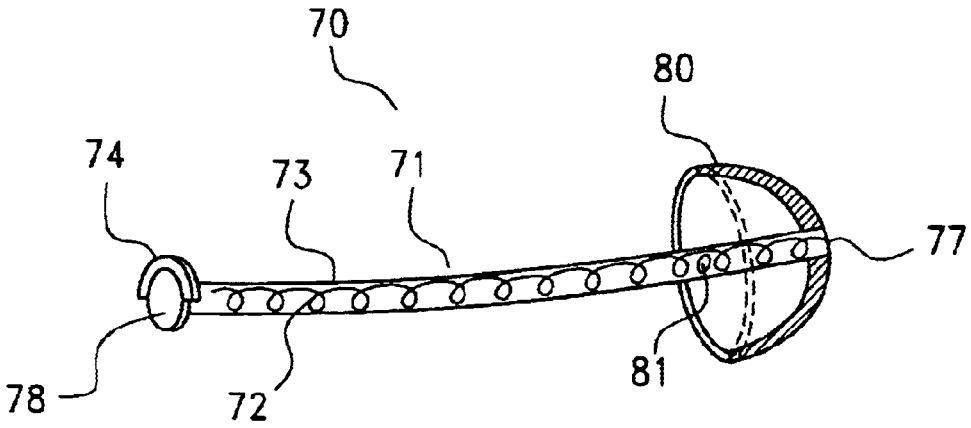
FIG. 15 shows a detailed view of a mushroom shaped tubular insert having only a primary system, and illustrating a coiled skeletal frame inserted within the sound tube and a small pressure vent incorporated on sound conduction tube lateral to the primary seal.

FIG. 15 shows a mushroom shaped primary seal 80 with pressure vent 81, tube connector 74, tubular sheath 73, and coil 72.

Figure 16:
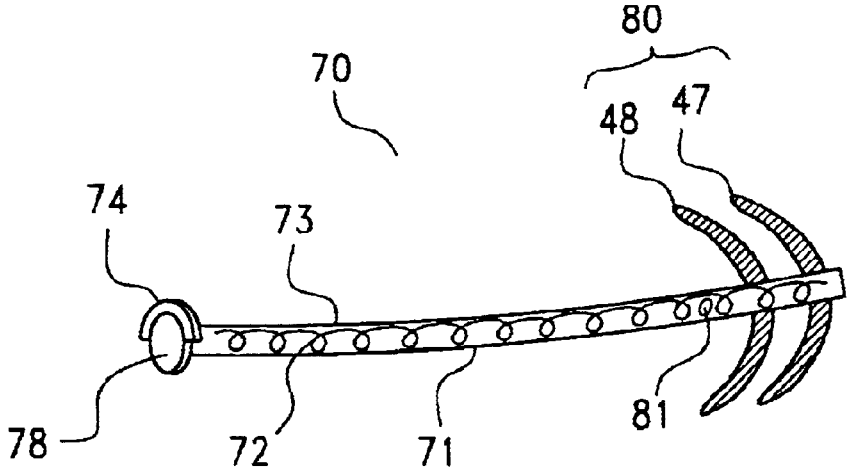
FIG. 16 shows a detailed view of a tubular insert also having only a primary seal, in which the primary seal comprises a cluster of two flanges.

FIG. 16 shows a primary seal 80 in clustered dual flange configuration with a medial flange 47 and a lateral flange 48.

The main module may be fitted completely in the ear canal medially past the aperture 17 as shown in FIG. 17. This embodiment, representing a CIC hearing configuration, comprises a tubular insert 70 with a primary seal 80 well into the bony region 13. The tubular insert 70 is connected to main module 50 via receiver connector 42. A relatively long handle 41 is provided to facilitate insertion and removal of the CIC hearing device 40. An occlusion-relief vent 23 is incorporated within main housing 50 for providing a path of least resistance compared with the pressure vent 81 on the sound conduction tube 71 for pressure venting of the primary seal 80.

Figure 18:
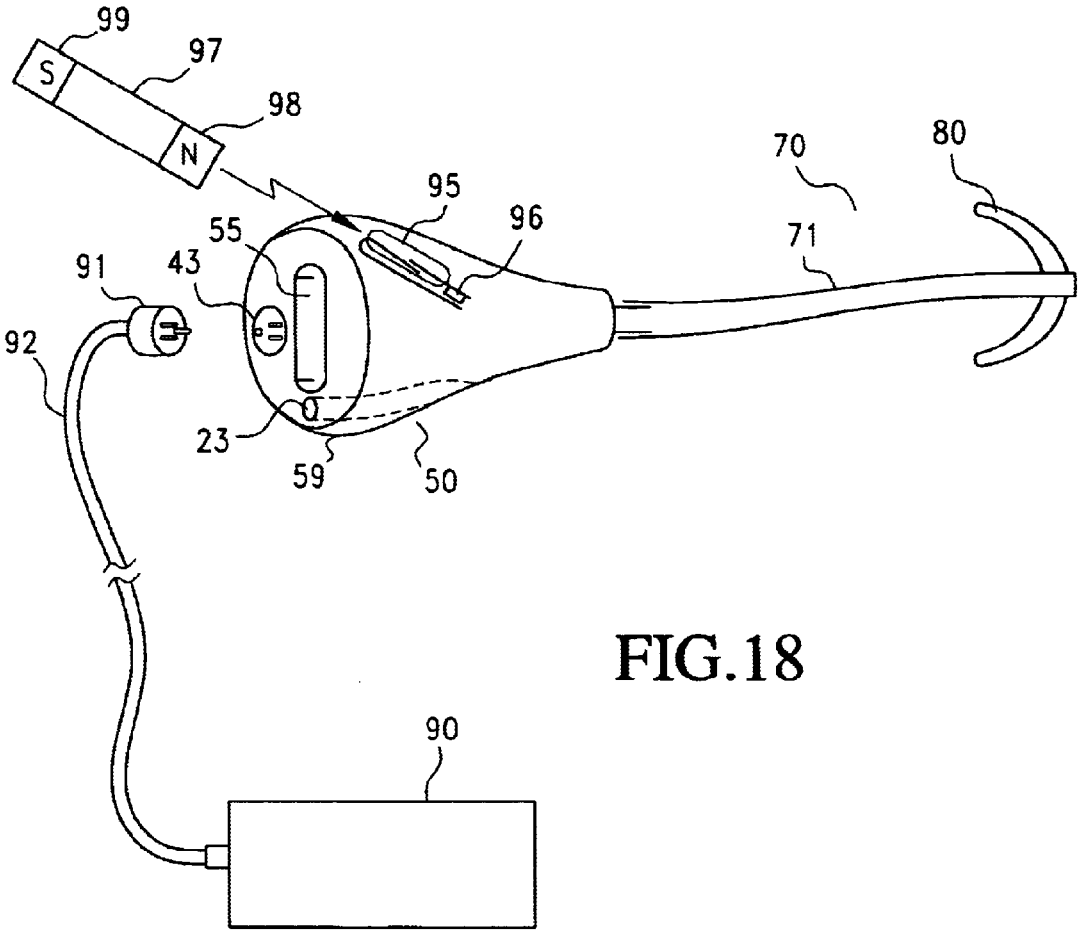
FIG. 18 shows an electrically programmable version of the hearing device of the invention, the device being electrically connected to an external programmer, and with latchable reed switch controlled by an external control magnet in proximity to the device.

The secondary seal, whether part of a tubular insert 70 (FIGS. 4–7), or part of main module 50 (FIGS. 14–17), presents a barrier for external unamplified sounds thus attenuating and interfering with unamplified sounds when entering the ear canal. However, this invention is not concerned with allowing unamplified sounds to enter the ear canal; instead, the concern here is to seal amplified sounds delivered near the tympanic membrane while providing significant occlusion relief The hearing device 40 of the present invention may be manually adjusted with manual controls (not shown) as well known in the field of hearing aid design. The hearing device 40 may also be electrically programmable also well known as shown in FIG. 18. A programmable hearing device typically comprises a programmable connector 43 for receiving electrical signals from a programming plug 91 connected via a cable 92 to a programming device 90. The programming device 90 is typically incorporated within a computer system (not shown). The main housing 50 comprises a battery door 55 and occlusion relief vent 23. The programming and control of hearing devices may be wireless (not shown) via radio frequency (RF), ultrasound, infrared (IR), electromagnetic (EM) or other methods as widely known in the field of wireless hearing aid programming.

The main module may comprise a reed-switch 95 (FIG. 18) with a latching magnet 96 for remote control by a control magnet 97. The reed-switch 95 can be used to turn on/off the hearing device or to adjust one or more parameters of the hearing device. The control magnet 97 is shown in the shape of a bar with south 99 (S) and north 98 (N) magnetic polarities across its length. The user selects one side or the other for switching the device ON or OFF as desired.

Figure 19:
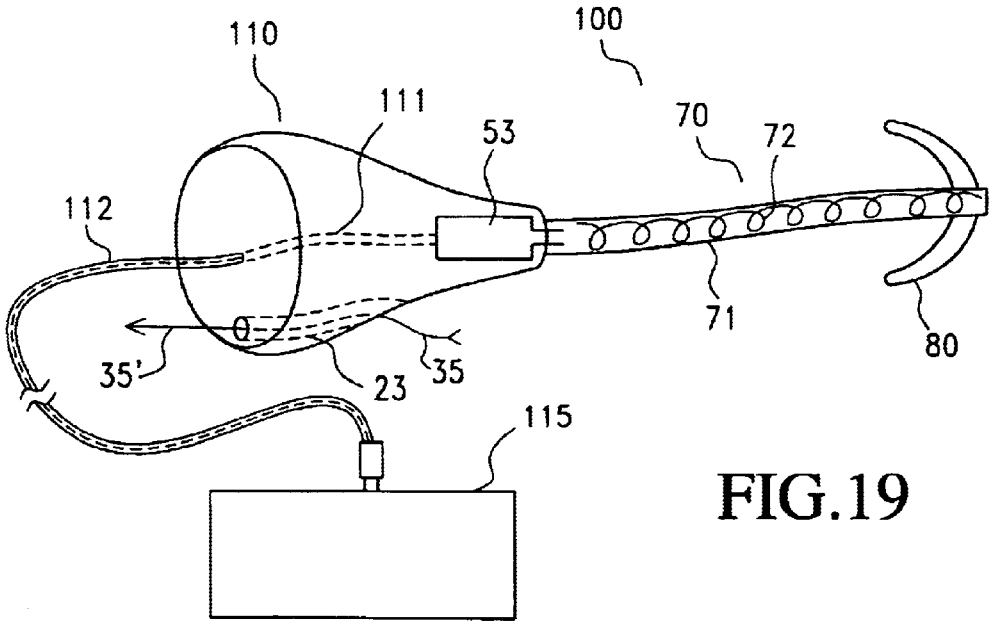
FIG. 19 shows a hearing device of the invention used for audio listening applications, with a main module comprising a receiver electrically connected to an external audio device.

The hearing devices of the above embodiments are suitable for use by hearing impaired individuals. However, the unique characteristics of the dual seal system may be equally applicable for audio and other communication applications. For example, FIG. 19 shows a hearing device 100 for audio applications comprising a main module 110 and a replaceable tubular insert 70. The tubular insert comprises a primary seal 80 and a sound conduction tube 71 with skeletal frame 72 within. The primary seal 80 ensures energy efficient reproduction of sound, particularly at high frequencies, near the tympanic membrane. The main housing 110 comprises an occlusion-relief vent 23 for leaking out occlusion sounds 35 to the outside of the ear (arrow 35'). In this application, the main module 110 essentially contains a receiver 52, which is connected via electrical wires 111 within electrical cable 112 to an audio device 115 external to the ear. Similarly, the hearing device for audio applications may be wirelessly connected to an external audio device via the appropriate wireless communication method (not shown).

Experiment A

In a study performed by the applicants herein, the cross-sectional dimensions of ear canals were measured from 10 canal impressions obtained from adult cadaver ears. The long (vertical) and short (horizontal) diameters, $D_L$ and $D_S$ respectively, of cross sections at the center of the cartilaginous region 11 and bony region 13 were measured and shown in Table 1 below. The diameters where measured across the widest points of each cadaver impression at each of the two regions. All measurements were taken by a digital caliper (model CD-6"CS manufactured by Mitutoyo). The impression material used was low viscosity Hydrophilic Vinyl Polysiloxane (manufactured by Densply/Caulk) using a dispensing system (model Quixx manufactured by Caulk).

TABLE 1

| Sample | Cartilaginous Region Diameters in mm | | Bony Region Diameters in mm | |
|---|---|---|---|---|
| # | Short ($D_S$) | Long ($D_L$) | Short ($D_S$) | Long ($D_L$) |
| 1-R | 7.8 | 10.3 | 8.0 | 10.5 |
| 1-L | 7.8 | 11.9 | 8.1 | 11.2 |
| 2-R | 3.8 | 8.9 | 4.2 | 8.9 |
| 2-L | 5.3 | 8.1 | 4.3 | 8.6 |
| 3-R | 5.5 | 6.3 | 5.0 | 7.7 |
| 3-L | 4.9 | 6.5 | 4.9 | 7.3 |
| 4-R | 6.9 | 9.2 | 6.7 | 10.4 |
| 5-R | 6.9 | 9.2 | 7.5 | 9.5 |
| 5-L | 6.8 | 8.2 | 7.5 | 8.7 |
| 7-L | 6.3 | 7.0 | 4.9 | 6.7 |
| Average | 6.2 | 8.6 | 6.1 | 9.0 |

Results and Conclusion

Figures 12A, 12B, 12C:
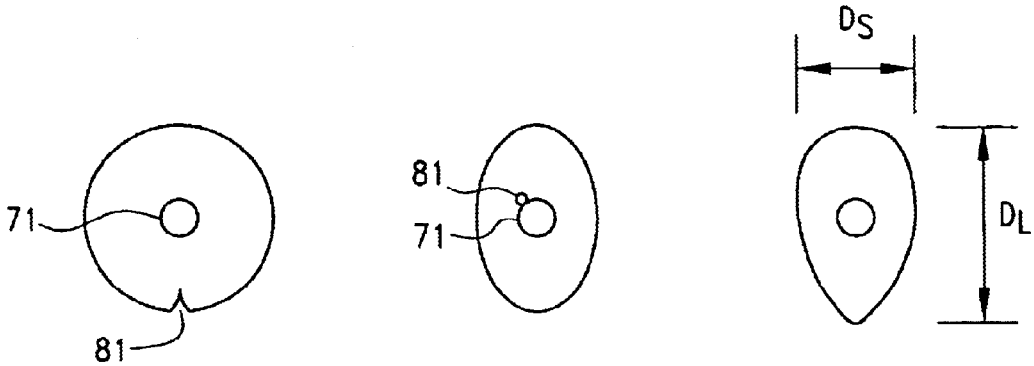
FIGS. 12A–C shows various cross-sectional shapes of seals: A. circular, B. elliptical, and C. oval and inferiorly pointed.

The diameter dimensions of the ear canal vary significantly among adult individuals. In general, variations occur more so across the short diameters ($D_S$). Although not apparent from the above measurements, the cartilaginous region is fleshy and thus somewhat expandable across the short diameter $D_S$. Based on the above measurements, a diameter of 2.5 mm (OD) or less for the sound conduction tube 71 was determined to be optimal for comfort of insertion. The cross sectional diameter of an assorted set of generic conforming primary seals, oval in design as shown in FIG. 12C, were selected according to above measurements as shown in Table 2 below.

TABLE 2

| Primary Seal Size | Short Diameter ($D_S$) in mm | Long Diameter ($D_L$) in mm |
|---|---|---|
| Small | 4.8 | 7.9 |
| Medium | 6.0 | 9.9 |
| Large | 8.2 | 13.6 |

Experiment B

Figure 20:
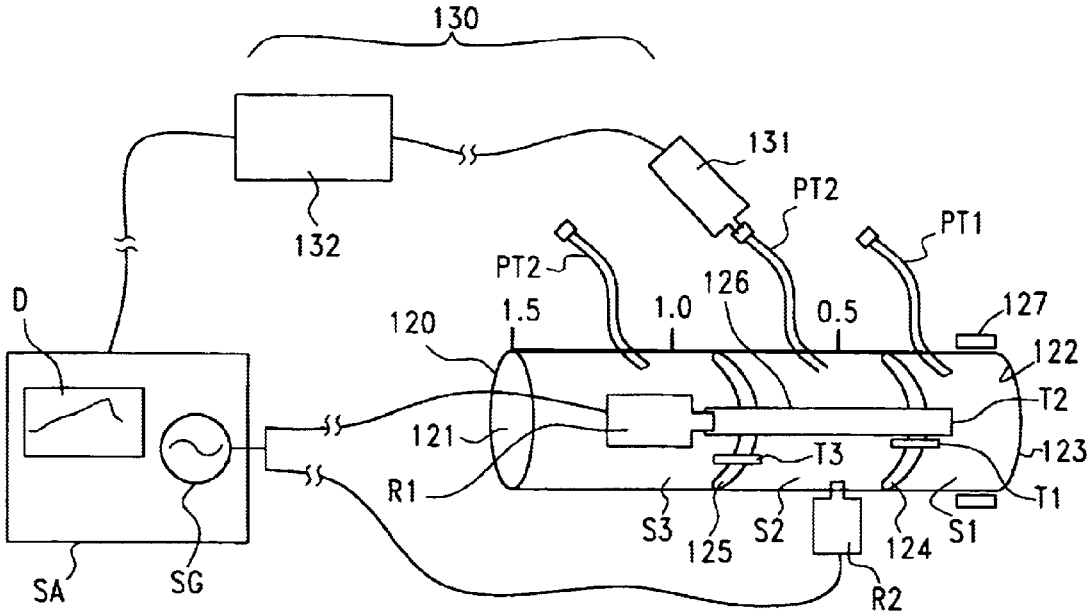
FIG. 20 shows a test setup for Experiment B to study the acoustic effects of the dual seal system in terms of acoustic sealing and occlusion relief.

The dual seal concept in relation to acoustic sealing (attenuation) and occlusion effects was simulated in a setup shown in FIG. 20. A test cavity 120, simulating an ear canal and a concha cavity, was produced from a cut section of a syringe. The test cavity 120 had a volume of 1.5 cubic centimeters (cc) with markings indicating the gradual volume within. The test cavity 120 had a lateral opening 121 and a medial opening 123 terminated by a thin diaphragm 123 simulating an eardrum. The test cavity had an ID of approximately 8.5 mm and length of about 27 mm.

The setup comprised a first receiver R1 (a speaker-model EH-7159 manufactured by Knowles Electronics of Itasca, Ill.) for producing acoustic sounds simulating a receiver 53 (FIGS. 4 and 6) of a hearing aid, and a second receiver R2 (also model EH-7195) for producing sounds simulating occlusion sounds 35 (FIGS. 4 and 6). The receivers R1 and R2 were connected to a signal generator (SG) incorporated within a spectrum analyzer (SA), model SRS-780 manufactured by Stanford Research Systems.

A primary seal 124 and secondary seal 125 were fabricated of rubber having a sealing contact along the inside wall of the test cavity 120 spanning a length of approximately 3.4 mm. The primary seal 124 and diaphragm 123 formed a first chamber or space S1. The primary seal 124 and secondary seal 125 formed a second chamber or space S2. Medial to the secondary seal 125, a third open space S3 is formed simulating the concha cavity 2 of an ear. The primary seal 124 was inserted medially past the 0.5 cc marking in order to simulate a deep positioning within the bony region of an ear canal. The secondary seal 125 was inserted medially past the 1.0 cc marking which roughly simulates the aperture of an ear canal.

A sound conduction tube T2, of approximately 13 mm in length and 1.5 mm ID, connected R1 receiver to the first space S1 as shown. An occlusion relief vent in the form of a tube T3, connected the second space S2 to third space S3. T3 had an ID of approximately 1.5 mm and length of 5 mm. A pressure vent T1, also in the form of a tube, measured 0.5 mm in ID and 3.5 mm in length. Based on the above dimensions, the cross sectional area of the occlusion relief vent T3 was approximately 9 times that of pressure vent T1.

The sound pressure level, or response, produced by either receiver (R1 or R2) was measured at S1, S2 and S3 spaces by probe tubes PT1, PT2 and PT3, respectively. The thin probe tubes were inserted in holes drilled in the syringe as shown in FIG. 20. Depending on the measurement, each probe tube was connected to probe tube measuring system 130 (model ER-7C, manufactured by Etymotic Research) consisting of probe microphone 131 and amplifier 132. Probe microphone 131 is shown connected to probe tube PT2. The probe tube measuring system 130 was also connected to the spectrum analyzer SA with results shown on its display D.

A thin plastic sheet of approximately 0.08 mm thickness was used for the construction of test diaphragm 123. The test diaphragm 123 was placed in a sealing manner over the medial opening 122 via a holding ring 127 as shown.

A chirp signal comprising equal amplitude of sinusoidal components between 125 to 4,000 Hz was used to measure response data in the range of standard audiometric frequencies.

It is important to note here that the test cavity 120 and diaphragm 123 represent only a crude model of the ear canal 10 and tympanic membrane 18. The experiment was merely designed to demonstrate the general effect of the dual seal concept as relating to sealing and occlusion. Actual results perceived by humans are likely to be different and varying according to the unique anatomy and physiology of each individual.

Referring to Table 3 below, the difference in the acoustic response of R1 measured by PT1 and PT2 represents the acoustic attenuation provided by the primary seal alone. The difference in the response between PT1 and PT3 represents the total acoustic attenuation. This includes not only the accumulative attenuation of the two seals, but also the effect of sound dispersion in the open cavity of S3. This simulated the leakage with respect to a microphone of the hearing device, which also resides laterally towards the open space of a concha cavity.

TABLE 3

| R1 Response in dB SPL | 125 Hz | 250 Hz | 500 Hz | 1000 Hz | 2000 Hz | 3000 Hz | 4000 Hz |
|---|---|---|---|---|---|---|---|
| @ PT1 | 56.4 | 66.6 | 71.8 | 70.0 | 68.3 | 70.9 | 74.7 |
| @ PT2 | 34.0 | 47.8 | 56.0 | 58.7 | 60.0 | 58.7 | 58.1 |
| @ PT3 | 22.7 | 26.3 | 30.3 | 34.0 | 40.3 | 43.6 | 47.0 |
| Primary seal atten. (dB) | 22.4 | 18.8 | 15.8 | 11.3 | 8.3 | 12.2 | 16.6 |
| Total atten. (dB) | 33.7 | 40.3 | 41.5 | 36.0 | 28.0 | 27.3 | 27.7 |

Referring to Table 4, below, the difference in acoustic responses of R2 measured by PT1 and PT2 represents the occlusion sound attenuation provided by the primary system. The difference in the acoustic responses of R2 measured by PT1 and PT3 is indicative of occlusion relief provided by the two seal system. For R2 response measurement at PT3, the lateral cavity S3 was closed in order to more accurately measure the magnitude of leaked occlusion sound (35' in FIG. 4) prior its dispersion.

TABLE 4

| R2 Response in dB SPL | 125 Hz | 250 Hz | 500 Hz | 1000 Hz | 2000 Hz | 3000 Hz | 4000 Hz |
|---|---|---|---|---|---|---|---|
| @ PT1 | 23.1 | 31.7 | 46.5 | 48.9 | 45.2 | 43.7 | 42.6 |
| @ PT2 | 30.5 | 42.2 | 52.7 | 60.4 | 71.1 | 76.9 | 70.7 |
| @ PT3 | 47.6 | 52.4 | 54.7 | 61.4 | 67.4 | 69.7 | 58.2 |
| Primary seal occlusion block (dB) | 7.4 | 10.5 | 6.2 | 11.5 | 25.9 | 33.2 | 28.1 |
| Total occlusion relief (dB) | 24.5 | 20.7 | 8.2 | 12.5 | 22.2 | 26 | 15.6 |

Results and Conclusion

Referring to Table 3 above, the attenuation (sealing) of the dual seal system was significantly higher than that of the primary seal alone even with the presence of a large vent associated with the secondary seal. The attenuation improvement occurred at all frequencies including higher frequencies, which are the primary frequencies causing oscillatory feedback in hearing aid use.

Referring to the Table 4 above, the occlusion relief was also significantly improved by the dual seal system, particularly for frequencies below 500 Hz, which are the primary frequencies causing occlusion effect in hearing aid use.

Experiment C

The acoustic conduction advantage, particularly high frequency boosting, of the tubular insert was tested according to the following experiment.

Figure 21:
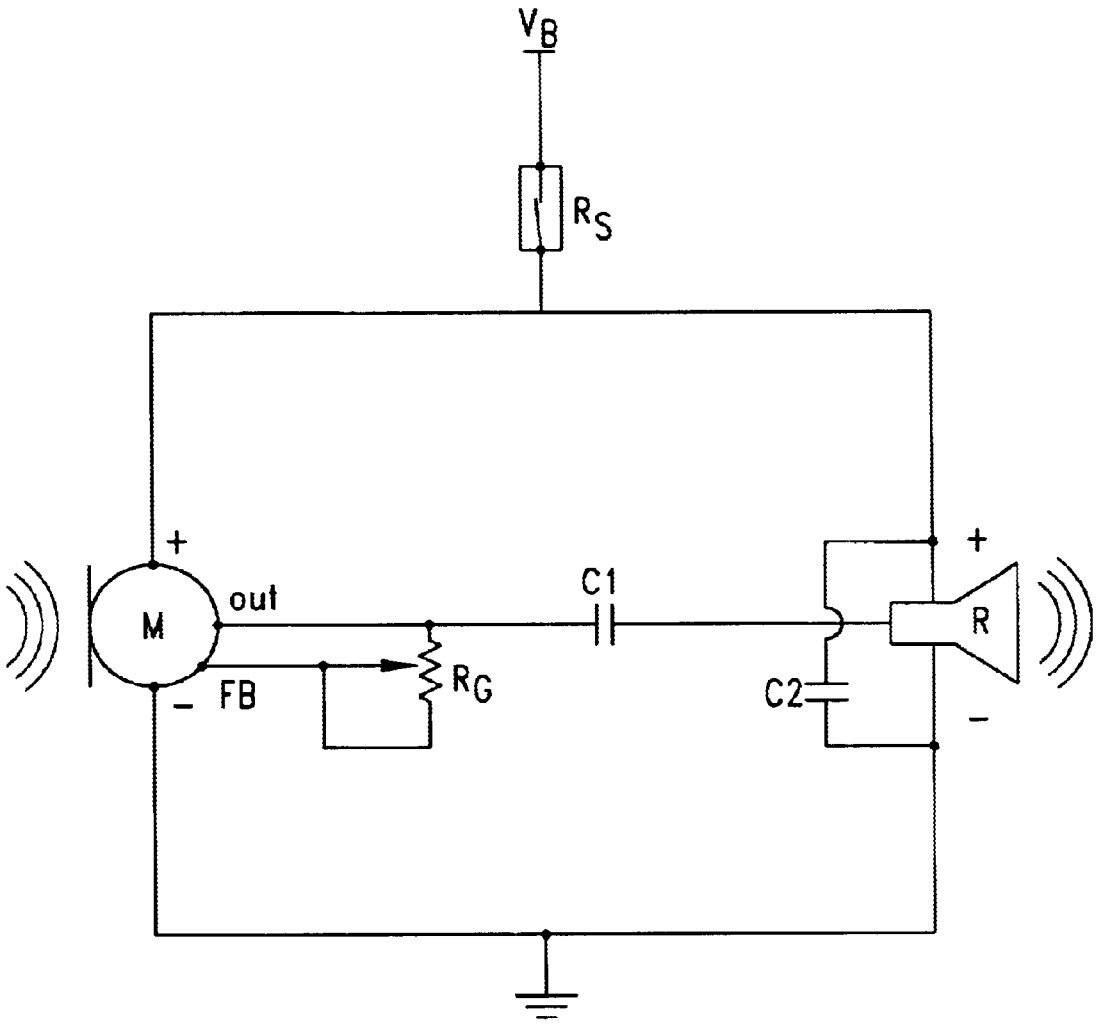
FIG. 21 shows the electrical schematics of a hearing device prototype constructed according to the present invention for studies described in Experiment C.

A prototype of the canal hearing device according to the embodiment of FIG. 4 was fabricated. The electroacoustic circuit of FIG. 21 was implemented with a miniature microphone/amplifier M (model FI-3342 manufactured by Knowles Electronics of Itasca, Ill.), class-D receiver R (model FS3379 also manufactured by Knowles Electronics) and miniature 450K Ohm volume trimmer $R_G$ (model PJ-62 manufactured by Microtronics A/S of Denmark). Volume trimmer $R_G$ was connected across the output terminal and the Feedback terminal FB of microphone M. Miniature capacitors C1 and $C_2$ with values of 0.01 uF and 2.2 uF, respectively were employed. A reed switch assembly (RS) employing a miniature reed-switch (model HSR-003DT, manufactured by Hermetic Switch, Inc. of Chickasha, Okla.) and a miniature Neudymium Iron Boron (NdFeB) magnet (96 in FIG. 18) were used for providing a latchable switch. The switch was remotely activated (on/off) by a control magnet in the shape of a bar as described above.

The tubular insert used comprised a sound conduction tube made of a silicone tube 15.6 mm in length, 2.4 mm OD and 1.58 mm ID. A metal coil was inserted in the sound conduction tube. The coil was approximately 13 mm in length, 1.61 mm OD and 1.49 mm ID.

The acoustic response of the prototype device for 60 dB SPL (sound pressure level) sinusoidal sweep was measured by standard hearing aid analysis methods employing a standard CIC coupler (Manufactured by Frye Electronics) and hearing aid analyzer (model Fonix 5500-Z also manufactured by Frye Electronics). The response curve was plotted (FIG. 22) with and without tubular insert (dotted line labeled "With 15.6 mm tubular insert", solid line labeled "Without tubular insert").

Results and Conclusion

Figure 22:
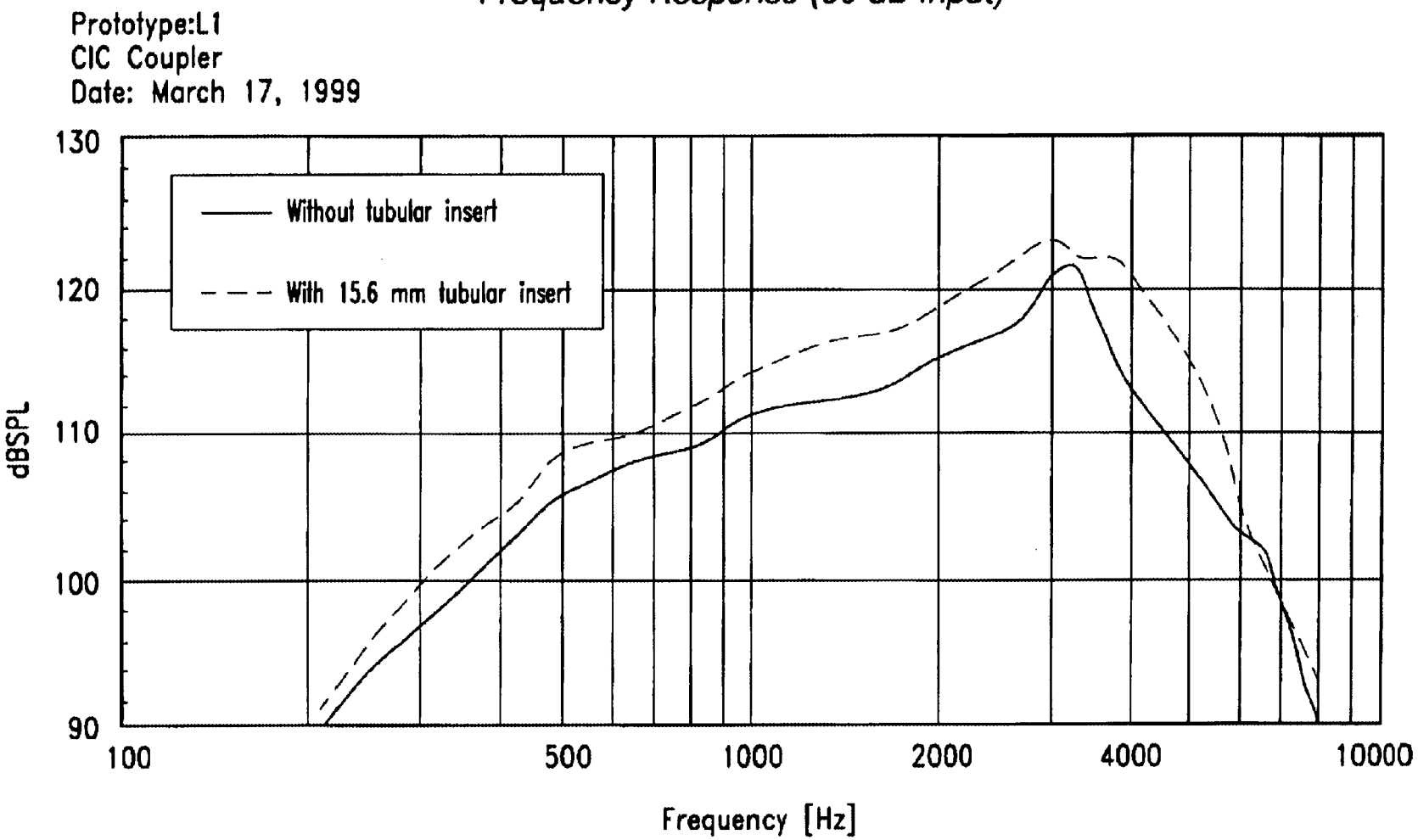
FIG. 22 shows the acoustic response curve of the hearing device with and without the tubular insert of the present invention.

Referring to FIG. 22, the tubular insert provided a significant boost in the acoustic response for frequencies greater than 500 Hz. The increase was particularly significant in the frequency range between 4 khz and 6 khz, reaching as much as 8 decibels. Similar experiments conducted by the inventors showed an increase at certain frequencies reaching as much as 14 decibels.

Although presently contemplated best modes of practicing the invention have been described herein, it will be recognized by those skilled in the art to which the invention pertains from a consideration of the foregoing description of presently preferred and alternate embodiments and methods of fabrication thereof, that variations and modifications of these exemplary embodiments and methods may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A canal hearing device comprising:

a main module, and a tubular insert axially connected to said main module;

said main module comprising a housing including a receiver for producing sound, said main module being constructed and adapted to be at least partially positioned in the cartilaginous part of an ear canal of a wearer of said device;

said tubular insert comprising a sound conduction tube having a diameter substantially less than the diameter of said ear canal, said sound conduction tube being constructed and adapted to be positioned in said ear canal for delivering sound produced by said receiver toward and in proximity of the tympanic membrane of said wearer; a primary seal concentrically positioned over said sound conduction tube to seal said car canal in the bony part thereof and to form a first space between said primary seal and said tympanic membrane, and a secondary seal positioned laterally of said primary seal to provide scaling in the cartilaginous part of said ear canal and to form a second space between said secondary seal and said primary seal when said canal hearing device is worn in said ear canal; and a venting system including a relatively small pressure vent associated with said primary seal, and a relatively larger occlusion-relief vent associated with said secondary seal to acoustically connect said second space to space outside of said ear canal, said occlusion-relief vent constituting a path of least acoustic resistance for leaking occlusion sounds relative to said pressure vent;

whereby, when said canal hearing device is worn in said ear canal, said venting system provides substantial acoustic sealing of sound delivered in said first space, while simultaneously attenuating said occlusion sounds by directing said occlusion sounds away from said tympanic membrane.

2. The canal hearing device of claim 1, wherein:

said tubular insert is constructed and adapted to be disposable for selective replacement thereof.

3. The canal hearing device of claim 1, wherein:

said tubular insert is radially flexible and axially sufficiently rigid for proper insertion of said device in said car canal.

4. The canal hearing device of claim 1, wherein:

said tubular insert possesses structural characteristics of being kink-resistant and non-collapsible when said device is inserted in said ear canal.

5. The canal hearing device of claim 4, wherein:

said sound conduction tube includes a skeletal frame incorporated therein to at least partially achieve said structural characteristics of said tubular insert.

6. The canal hearing device of claim 4, wherein:

said sound conduction tube includes circular, longitudinal, helical or braided elements therein to at least partially achieve said structural characteristics of said tubular insert.

7. The canal hearing device of claim 1, wherein:

said tubular insert has generic configurations and sizes, to accommodate any of a variety of ear canal sizes and shapes.

8. The canal hearing device of claim 1, wherein:

said tubular insert comprises multiple tubing for use either in multiple channel sound conduction or venting.

9. The canal hearing device of claim 1, wherein:

said sound conduction tube is at least 8 mm in length.

10. The canal hearing device of claim 1, wherein:

said sound conduction tube has an inside diameter not greater than 2 mm.

11. The canal hearing device of claim 1, wherein:

said sound conduction tube is constructed and adapted to provide a boost for conducted sounds at the high range of audiometric frequencies.

12. The canal hearing device of claim 1, wherein:

said pressure vent is in the form of a hole, cavity, slit, or tube having a diameter or width not greater than 0.5 mm.

13. The canal hearing device of claim 1, wherein:

said pressure vent is incorporated directly on said primary seal.

14. The canal hearing device of claim 1, wherein:

said pressure vent is indirectly incorporated along said sound conduction lube or a connector associated with said sound conduction tube.

15. The canal hearing device of claim 1, wherein:

said sound conduction tube is constructed and adapted to extend medially past the primary seal toward said tympanic membrane, when said canal hearing device is worn in said ear canal.

16. The canal hearing device of claim 1, wherein:

at least one of said primary seal and said secondary seal is hollow and of generally cylindrical shape.

17. The canal hearing device of claim 1, wherein:

at least one of said primary seal and said secondary seal is flanged, mushroom shaped, or clustered.

18. The canal hearing device of claim 1, wherein:

the cross sectional perimeter of at least one of said primary seal and said secondary seal is either circular, elliptical, or oval and inferiorly pointed.

19. The canal hearing device of claim 1, wherein:

at least one of said primary seal and said secondary seal is constructed and adapted to contact the walls of said ear canal with a span of at least 2 mm longitudinally, when said canal hearing device is worn in said ear canal.

20. The canal hearing device of claim 1, wherein:

said main module has a generic shape.

21. The canal hearing device of claim 1, wherein:

said main module is substantially vented.

22. The canal hearing device of claim 1, wherein:

said main module further comprises a receiver section having a diameter substantially less than the diameter of said ear canal, to allow insertion of said main module into the cartilaginous part of said ear canal medially past the aperture thereof.

23. The canal hearing device of claim 22, wherein:

said receiver section comprises a medial connector for removably connecting to said tubular insert.

24. The canal hearing device of claim 23, wherein:

said medial connector comprises either a snap-on, threaded, spring-loaded, pressure-fit, or side-slide mating mechanism.

25. The canal hearing device of claim 22, wherein:

said tubular insert further includes a tube connector for concentric coaxial connection of said receiver section to said tubular insert.

26. The canal hearing device of claim 1, wherein:

said secondary seal provides physical support for either the main module or the tubular insert.

27. The canal hearing device of claim 1, wherein:

said occlusion-relief vent comprises a cross sectional area at least 3 times that of said pressure vent.

28. The canal hearing device of claim 1, wherein:

said occlusion-relief vent is configured to provide acoustic impedance at least 10 decibels less than the acoustic impedance of said pressure vent for frequencies below 500 hz.

29. The canal hearing device of claim 1, further including:

manual control means associated with said device for manually adjusting at least one parameter thereof.

30. The canal hearing device of claim 1, further including:

remote control means associated with said device for remotely controlling or adjusting at least one parameter thereof.

31. The canal hearing device of claim 30, wherein:

said remote control means comprises one or more latchable reed switches within said main module, and an external control magnet for operation of said one or more latchable reed switches to effect said control or adjustment.

32. The canal hearing device of claim 1, further including:

means associated with said device for programming thereof.

33. The canal hearing device of claim 32, further including:

an electrical connector associated with said device for programming thereof.

34. The canal hearing device of claim 32, further including:

wireless connection means associated with said device for programming thereof.

35. The canal hearing device of claim 1, wherein:

said device is adapted for hearing enhancement of a hearing impaired wearer.

36. The canal hearing device of claim 1, wherein:

said device is adapted for audio communications.

37. The canal hearing device of claim 36, further including:

electrical connector means associated with said device for connection to an external audio device.

38. The canal hearing device or claim 1, further including:

wireless interface means associated with said device for receiving wireless signals.

39. A tubular insert adapted for axial connection to a hearing device, said tubular insert comprising:

a sound conduction tube constructed and adapted to be positioned in an ear canal of a wearer of said device for delivering sound produced by said device toward and in proximity of the tympanic membrane of said wearer, a primary seal concentrically positioned over said sound conduction tube to seal said ear canal in the bony part thereof and to form a first space between said primary seal and said tympanic membrane, and a secondary seal concentrically positioned over said sound conduction tube laterally of said primary seal to provide sealing in the cartilaginous part of said ear canal and to form a second space between said secondary seal and said primary seal when said tubular insert is worn in said ear canal; and a venting system including a relatively small pressure vent associated with said primary seal, and a relatively larger occlusion-relief vent associated with said secondary seal to acoustically connect said second space to space outside of said ear canal, said occlusion-relief vent constituting a path of least acoustic resistance for leaking occlusion sounds relative to said pressure vent;

whereby, when said tubular insert is worn in said ear canal, said venting system provides substantial acoustic sealing for sound delivered in said first space, while simultaneously attenuating occlusion sounds in said first space by directing said occlusion sounds away from said tympanic membrane.

40. The tubular insert of claim 39, wherein:

said tubular insert is constructed and adapted to be disposable for selective replacement thereof.

41. The tubular insert of claim 39, wherein:

said tubular insert is radially flexible and axially sufficiently rigid for proper insertion of said tubular insert in said ear canal.

42. The tubular insert of claim 39, wherein:

said tubular insert is constructed and adapted to possess structural characteristics of kink-resistance and non-collapse when inserted in said ear canal.

43. The tubular insert of claim 42, wherein:

said sound conduction tube includes a skeletal frame incorporated therein to at least partially produce said structural characteristics.

44. The tubular insert of claim 42, wherein:

said sound conduction tube includes circular, longitudinal, helical or braided elements therein to at least partially produce said structural characteristics.

45. The tubular insert of claim 39, wherein:

said tubular insert has generic configurations and sizes to accommodate any of a variety of ear canal sizes and shapes.

46. The tubular insert of claim 39, including:

multiple tubing for either multiple channel sound conduction or venting.

47. The tubular insert of claim 39, wherein:

said sound conduction tube is at least 8 mm in length.

48. The tubular insert of claim 39, wherein:

said sound conduction tube has an inside diameter not greater than 2 mm.

49. The tubular insert of claim 39, wherein:

said sound conduction tube is constructed and adapted to provide a boost for conducted sounds at the high range of audiometric frequencies.

50. The tubular insert of claim 39, wherein:

said pressure vent is in the form of a hole, cavity, slit, or tube having a diameter or width not greater than 0.5 mm.

51. The tubular insert of claim 39, wherein:

said pressure vent is incorporated directly on said primary seal.

52. The tubular insert of claim 39, wherein:

said pressure vent is indirectly incorporated along said sound conduction tube or a connector associated with said sound conduction tube.

53. The tubular insert of claim 39, wherein:

said sound conduction tube is constructed and adapted to extend medially past said primary seal toward said tympanic membrane, when said tubular insert is worn in said ear canal.

54. The tubular insert of claim 39, wherein:

at least one of said primary seal and said secondary seal is hollow and of generally cylindrical shape.

55. The tubular insert of claim 39, wherein:

at least one of said primary seal and said secondary seal is flanged, mushroom shaped, or clustered.

56. The tubular insert of claim 39, wherein:

the cross sectional perimeter of at least one of said primary seal and said secondary seal is either circular, elliptical, or oval and inferiorly pointed.

57. The tubular insert of claim 39, wherein:

at least one of said primary seal and said secondary seal is constructed and adapted to contact the walls of said ear canal with a span of at least 2 mm longitudinally, when said tubular insert is worn in said ear canal.

58. The tubular insert of claim 39, wherein:

at least one of said primary seal and said secondary seal further comprises medication material selected from a group including anti-bacterial and anti-microbial agents.

59. The tubular insert of claim 39, wherein:

at least one of said primary seal and said secondary seal further comprises lubricant to facilitate insertion and removal of said tubular insert into and from said ear canal.

60. The tubular insert of claim 39, including:

means for removably connecting said tubular insert to a receiver section within said hearing device.

61. The tubular insert of claim 60, wherein:

said connecting means comprises a snap-on, threaded, spring-loaded, pressure-fit, or side-slide mating mechanism.

62. The tubular insert of claim 60, further including:

a tube connector for concentric coaxial connection of said tubular insert over said receiver section.

63. The tubular insert of claim 39, wherein:

said occlusion-relief vent comprises a cross sectional area at least 3 times that of said pressure vent.

64. The tubular insert of claim 39, wherein:

said occlusion-relief vent is configured to provide acoustic impedance at least 10 decibels less than the acoustic impedance of said pressure vent for frequencies below 500 hz.

65. The tubular insert of claim 39, including:

means adapting said tubular insert for hearing enhancement of a hearing impaired wearer.

66. The tubular insert of claim 39, including:

means adapting said tubular insert for audio communications.

67. A canal hearing device comprising:

a main module, and a tubular insert axially connected to said main module;

said main module comprising a housing including a receiver for producing sound, said main module being constructed and adapted to be at least partially positioned in the cartilaginous part of an ear canal of a wearer of said device;

said tubular insert comprising a sound conduction tube having a diameter substantially less than the diameter of said ear canal, said sound conduction tube being constructed and adapted to be positioned in said ear canal for delivering sound produced by said receiver toward and in proximity of the tympanic membrane of said ear canal, and a primary seal concentrically positioned over said sound conduction tube to seal said ear canal and to form a first space between said primary seal and said tympanic membrane when said device is worn in said ear canal, said primary seal having an associated pressure vent for said first space;

said main module further comprising a secondary seal to provide sealing in the cartilaginous part of said ear canal lateral to said primary seal and forming a second space between said primary and secondary seals when said main module and said tubular insert are connected and worn in said ear canal, and an occlusion-relief vent acoustically connecting said second space to space outside of said car canal, said occlusion-relief vent constituting a path of least acoustic resistance relative to said pressure vent;

whereby, when said canal hearing device is worn in said ear canal, said primary and secondary seals and occlusion-relief vent, in combination, provide substantial acoustic sealing of sound delivered in said first space, while simultaneously attenuating occlusion sounds by directing said occlusion sounds away from said tympanic membrane.

68. The canal hearing device of claim 67, wherein:

said tubular insert is constructed and adapted to be disposable for selective replacement thereof.

69. The canal hearing device of claim 67, wherein:

said tubular insert is radially flexible and axially sufficiently rigid for proper insertion of said device in said ear canal.

70. The canal hearing device of claim 67, wherein:

said tubular insert has structural characteristics of being kink-resistant and non-collapsible when said device is inserted in said ear canal.

71. The canal hearing device of claim 70, wherein:

said sound conduction tube includes a skeletal frame incorporated therein to at least partially produce said structural characteristics of said tubular insert.

72. The canal hearing device of claim 70, wherein:

said sound conduction tube includes circular, longitudinal helical or braided elements therein to at least partially produce said structural characteristics of said tubular insert.

73. The canal hearing device of claim 67, wherein:

said tubular insert has generic configurations and sizes to accommodate any of a variety of ear canal sizes and shapes.

74. The canal hearing device of claim 67, wherein:

said tubular insert comprises multiple tubing for either conduction of multiple channel sound or venting.

75. The canal hearing device of claim 67, wherein:

said sound conduction tube is at least 8 mm in length.

76. The canal hearing device of claim 67, wherein:

said sound conduction tube has an inside diameter not greater than 2 mm.

77. The canal hearing device of claim 67, wherein:

said sound conduction tube is constructed and adapted to provide a boost for conducted sounds at the high range of audiometric frequencies.

78. The canal hearing device of claim 67, wherein:

said pressure vent is in the form of a hole, cavity, slit, or tube having a diameter or width not greater than 0.5 mm.

79. The canal hearing device of claim 67, wherein:

said pressure vent is incorporated directly on said primary seal.

80. The canal hearing device of claim 67, wherein:

said pressure vent is indirectly incorporated along said sound conduction tube or a connector associated with said sound conduction tube.

81. The canal hearing device of claim 67, wherein:

said sound conduction tube is constructed and adapted to extend medially past said primary seal toward said tympanic membrane, when said canal hearing device is worn in said ear canal.

82. The canal hearing device of claim 67, wherein:

said primary seal is hollow and of generally cylindrical shape.

83. The canal hearing device of claim 67, wherein:

said primary seal is flanged, mushroom shaped, or clustered.

84. The canal hearing device of claim 67, wherein:

the cross sectional perimeter of said primary seal is either circular, elliptical, or oval and inferiorly pointed.

85. The canal hearing device of claim 67, wherein:

said primary seal is constructed and adapted to contact the walls of said ear canal with a span of at least 2 mm longitudinally, when said canal hearing device is worn in said ear canal.

86. The canal hearing device of claim 67, wherein:

said main module has a generic shape.

87. The canal hearing device of claim 67, wherein:

said main module is substantially vented for occlusion relief.

88. The canal hearing device of claim 67, wherein:

said main module further comprises a receiver section having a diameter substantially less than the diameter of said ear canal, for insertion of said main module into the cartilaginous part of said ear canal medially past the aperture thereof.

89. The canal hearing device of claim 88, wherein:

said receiver section comprises a medial connector for removably connecting to said tubular insert.

90. The canal hearing device of claim 89, wherein:

said medial connector comprises either a snap-on, threaded, spring-loaded, pressure-fit, or side-slide mating mechanism.

91. The canal hearing device of claim 88, wherein:

said tubular insert further includes a tube connector for concentric coaxial connection of said receiver section to said tubular insert.

92. The canal hearing device of claim 67, wherein:

said occlusion-relief vent comprises a cross sectional area at least 3 times that of said pressure vent.

93. The canal hearing device of claim 67, wherein:

said occlusion-relief vent is configured to provide acoustic impedance at least 10 decibels less than the acoustic impedance of said pressure vent for frequencies below 500 hz.

94. The canal hearing device of claim 67, further including:

manual control means associated with said device for manually adjusting at least one parameter thereof.

95. The canal hearing device of claim 67, further including:

remote control means associated with said device for remotely controlling or adjusting at least one parameter thereof.

96. The canal hearing device of claim 95, wherein:

said remote control means comprises one or more latchable reed switches within said main module, and an external control magnet for operation of said one or more latchable reed switches to effect said control or adjustment.

97. The canal hearing device of claim 67, further including:

means associated with said device for programming thereof.

98. The canal hearing device of claim 97, further including:

an electrical connector associated with said device for programming thereof.

99. The canal hearing device of claim 97, further including:

wireless connection means associated with said device for programming thereof.

100. The canal hearing device of claim 67, wherein:

said device is adapted for hearing enhancement of a hearing impaired wearer.

101. The canal hearing device of claim 67, wherein:

said device is adapted for audio communications.

102. The canal hearing device of claim 101, further including:

electrical connector means associated with said device for connection to an external audio device.

103. The canal hearing device of claim 67, further including:

wireless interface means associated with said device for receiving wireless signals.

* * * * *